US011640120B2

(12) United States Patent
Shibuya et al.

(10) Patent No.: US 11,640,120 B2
(45) Date of Patent: May 2, 2023

(54) IMAGE FORMING APPARATUS AND IMAGE FORMING METHOD

(71) Applicant: KYOCERA Document Solutions Inc., Osaka (JP)

(72) Inventors: Teppei Shibuya, Osaka (JP); Masahito Ishino, Osaka (JP); Toshiki Fujita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 193 days.

(21) Appl. No.: 17/261,986

(22) PCT Filed: Jul. 16, 2019

(86) PCT No.: PCT/JP2019/027898

§ 371 (c)(1),
(2) Date: Jan. 21, 2021

(87) PCT Pub. No.: WO2020/026787

PCT Pub. Date: Feb. 6, 2020

(65) Prior Publication Data

US 2021/0263434 A1 Aug. 26, 2021

(30) Foreign Application Priority Data

Jul. 31, 2018 (JP) ..... JP2018-143070

(51) Int. Cl.
*G03G 9/08* (2006.01)
*G03G 5/06* (2006.01)
(Continued)

(52) U.S. Cl.
CPC ..... *G03G 9/0827* (2013.01); *G03G 5/056* (2013.01); *G03G 5/0609* (2013.01);
(Continued)

(58) Field of Classification Search
CPC .. G03G 9/0827; G03G 5/06145; G03G 5/056; G03G 5/0609; G03G 5/0819; G03G 21/0011
See application file for complete search history.

(56) References Cited

U.S. PATENT DOCUMENTS

2005/0079431 A1* 4/2005 Kobashi ..... G03G 5/056 430/96
2011/0299888 A1* 12/2011 Miyaji ..... G03G 5/04 399/176

(Continued)

FOREIGN PATENT DOCUMENTS

JP 2000-075752 A 3/2000

*Primary Examiner* — Peter L Vajda
*Assistant Examiner* — Boone Alexander Evans
(74) *Attorney, Agent, or Firm* — Studebaker & Brackett PC

(57) ABSTRACT

An image forming apparatus includes an image bearing member, a charger, a light exposure device, a development device, a transfer belt, a primary transfer device, a secondary transfer device, and a cleaning member. The cleaning member is pressed against a circumferential surface of the image bearing member and collects residual toner remaining on the circumferential surface of the image bearing member as a result of primary transfer of a toner. The transfer belt has a surface resistivity of at least 6 Log Ω and no greater than 11 Log Ω. A linear pressure of the cleaning member on the circumferential surface of the image bearing member is at least 10 N/m and no greater than 40 N/m. The image bearing member includes a conductive substrate and a photosensitive layer of a single layer. The image bearing member satisfies formula (1):

$$0.06 \leqq \frac{V}{(Q/S)\times(d/\varepsilon_r\cdot\varepsilon_0)}. \quad (1)$$

9 Claims, 14 Drawing Sheets

(51) Int. Cl.
*G03G 5/05* (2006.01)
*G03G 21/00* (2006.01)

(52) U.S. Cl.
CPC ..... *G03G 5/06145* (2020.05); *G03G 9/0819* (2013.01); *G03G 21/0011* (2013.01)

(56) References Cited

U.S. PATENT DOCUMENTS

2016/0041513 A1* 2/2016 Takeda ..... G03G 15/162
399/302
2016/0124327 A1* 5/2016 Fujii ..... G03G 5/056
430/57.1
2017/0068177 A1* 3/2017 Shimizu ..... G03G 5/102
2017/0082970 A1* 3/2017 Inagaki ..... G03G 5/14791

* cited by examiner

IMAGE FORMING APPARATUS AND IMAGE FORMING METHOD

TECHNICAL FIELD

The present disclosure relates to an image forming apparatus and an image forming method.

BACKGROUND ART

An electrophotographic image forming apparatus collects toner remaining on the circumferential surface of an image bearing member therein using a cleaning member (e.g., a cleaning blade). In order to form high-definition images, it is desirable to use a toner having a small particle diameter and a high roundness. However, such a toner easily passes through a gap between the cleaning member and the circumferential surface of the image bearing member, tending to cause insufficient cleaning. In order to prevent insufficient cleaning, for example, it has been contemplated to tightly press the cleaning member against the image bearing member. However, the cleaning member tightly pressed against the image bearing member rubs hard on the circumferential surface of the image bearing member, and as a result some failure may occur in the image bearing member.

In order to reduce friction force between the cleaning member and the circumferential surface of the image bearing member, for example, it has been contemplated to apply a lubricant to the image bearing member. An image forming apparatus for example disclosed in Patent Literature 1 includes a lubricant application mechanism disposed upstream of a cleaning means for the image bearing member.

CITATION LIST

Patent Literature

[Patent Literature 1] Japanese Patent Application Laid-Open Publication No. 2000-075752

SUMMARY OF INVENTION

Technical Problem

However, the image forming apparatus disclosed in Patent Literature 1 includes a lubricant application mechanism. This complicates the configuration of the image forming apparatus to increase manufacturing cost. Furthermore, irregularity in lubricant application on the image bearing member may occur in the image forming apparatus disclosed in Patent Literature 1. The inventors' study revealed that such application irregularity tends to cause a ghost image.

The present invention has been made in view of the foregoing and has its object of providing an image forming apparatus and an image forming method capable of inhibiting occurrence of a ghost image and toner charge-up.

Solution to Problem

An image forming apparatus according to the present invention includes an image bearing member, a charger, a light exposure device, a development device, a transfer belt, a primary transfer device, a secondary transfer device, and a cleaning member. The charger charges a circumferential surface of the image bearing member to a positive polarity. The light exposure device exposes the charged circumferential surface of the image bearing member to light to form an electrostatic latent image on the circumferential surface of the image bearing member. The development device develops the electrostatic latent image into a toner image through supply of a toner to the electrostatic latent image. The transfer belt is in contact with the circumferential surface of the image bearing member. The primary transfer device primarily transfers the toner image from the circumferential surface of the image bearing member to the transfer belt. The secondary transfer device secondarily transfers the toner image from the transfer belt to a recording medium. The cleaning member is pressed against the circumferential surface of the image bearing member and collects residual toner of the toner remaining on the circumferential surface of the image bearing member as a result of the toner being primarily transferred. The transfer belt has a surface resistivity of at least 6 Log Ω and no greater than 11 Log Ω. A linear pressure of the cleaning member on the circumferential surface of the image bearing member is at least 10 N/m and no greater than 40 N/m. The image bearing member includes a conductive substrate and a photosensitive layer of a single layer. The photosensitive layer contains a charge generating material, a hole transport material, an electron transport material, and a binder resin. The image bearing member satisfies formula (1).

$$0.60 \leqq \frac{V}{(Q/S) \times (d/\varepsilon_r \cdot \varepsilon_0)} \tag{1}$$

In the formula (1), Q represents a charge amount of the image bearing member. S represents a charge area of the image bearing member. d represents a film thickness of the photosensitive layer. $\varepsilon_r$ represents a specific permittivity of the binder resin contained in the photosensitive layer. $\varepsilon_0$ represents the vacuum permittivity. V represents a value calculated from an equation $V=V_0-V_r$. $V_r$ represents a first potential of the circumferential surface of the image bearing member yet to be charged by the charger. $V_0$ represents a second potential of the circumferential surface of the image bearing member charged by the charger.

An image forming method according to the present invention includes charging, exposing to light, developing, performing primary transfer, performing secondary transfer, and performing cleaning. In the charging, a circumferential surface of an image bearing member is charged to a positive polarity. In the exposing to light, the charged circumferential surface of the image bearing member is exposed to light to form an electrostatic latent image on the circumferential surface of the image bearing member. In the developing, the electrostatic latent image is developed into a toner image through supply of a toner to the electrostatic latent image. In the performing primary transfer, the toner image is primarily transferred from the circumferential surface of the image bearing member to a transfer belt that is in contact with the circumferential surface. In the performing secondary transfer, the toner image is secondarily transferred from the transfer belt to a recording medium. In the performing cleaning, cleaning is performed to collect residual toner by pressing a cleaning member against the circumferential surface of the image bearing member. The residual toner is toner of the toner remaining on the circumferential surface of the image bearing member as a result of the primary transfer of the toner image. The transfer belt has a surface resistivity of at least 6 Log Ω and no greater than 11 Log Ω. A linear pressure of the cleaning member on the circumferential surface of the image bearing member is at least 10 N/m and no greater than 40 N/m. The image bearing member includes a conductive substrate and a photosensitive layer of a single layer. The photosensitive layer contains a charge generating material, a hole transport material, an electron transport material, and a binder resin. The image bearing member satisfies formula (1).

$$0.60 \leqq \frac{V}{(Q/S)\times(d/\varepsilon_r\cdot\varepsilon_0)} \quad (1)$$

In the formula (1), Q represents a charge amount of the image bearing member. S represents a charge area of the image bearing member. d represents a film thickness of the photosensitive layer. $\varepsilon_r$ represents a specific permittivity of the binder resin contained in the photosensitive layer. $\varepsilon_0$ represents the vacuum permittivity. V represents a value calculated from an equation $V=V_0-V_r$. $V_r$ represents a first potential of the circumferential surface of the image bearing member yet to be charged in the charging. $V_0$ represents a second potential of the circumferential surface of the image bearing member charged in the charging.

Advantageous Effects of Invention

With the image forming apparatus according to the present invention and the image forming method according to the present invention, occurrence of a ghost image and toner charge-up can be inhibited.

DESCRIPTION OF EMBODIMENTS

Figure 1:
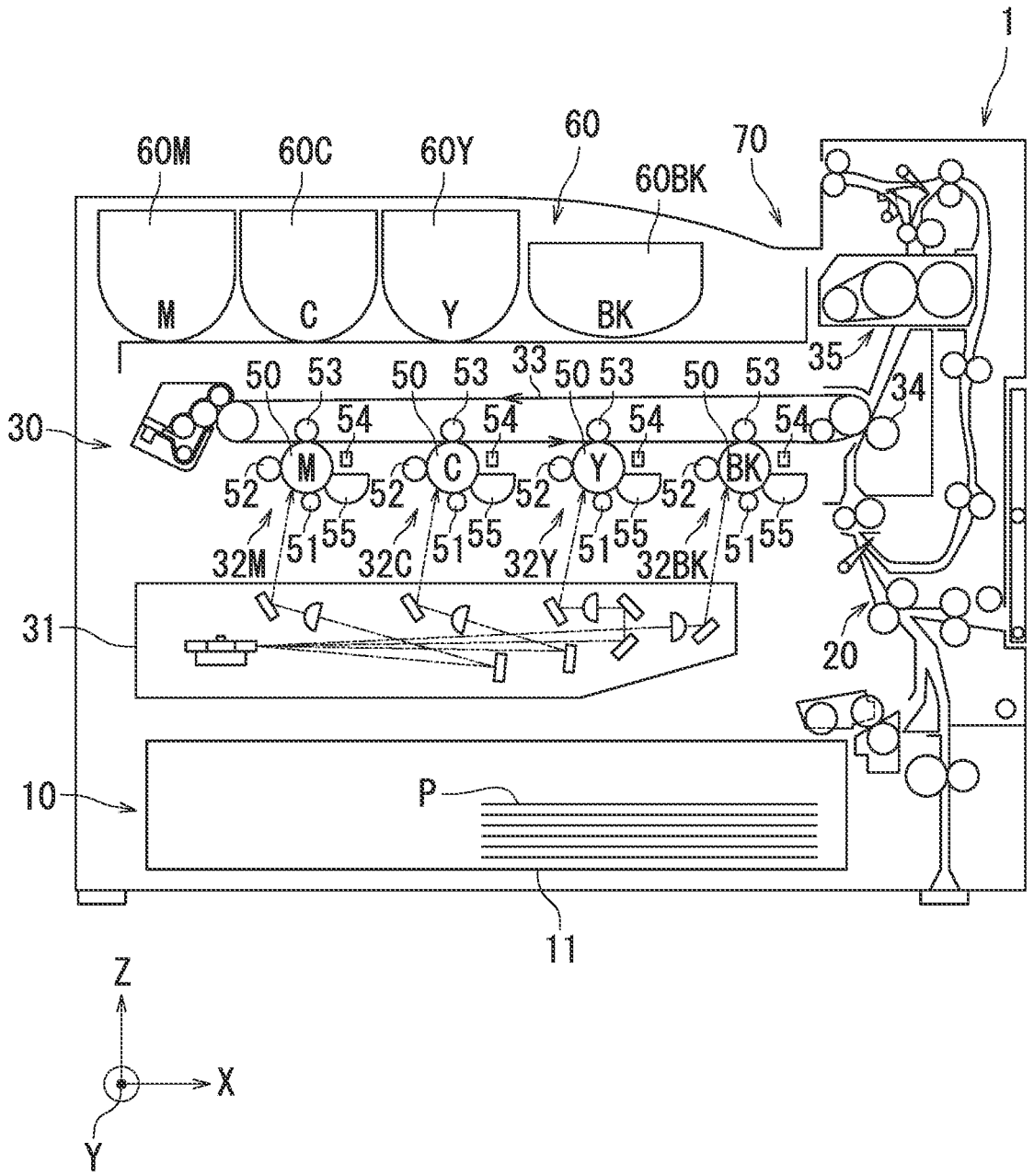
FIG. 1 is a cross-sectional view of an image forming apparatus according to a first embodiment of the present invention.

First of all, terms used in the present description will be described. The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, a halogen atom, an alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, and an alkoxy group having a carbon number of at least 1 and no greater than 4 each refer to the following unless otherwise stated.

Examples of the halogen atom (halogen groups) include a fluorine atom (a fluoro group), a chlorine atom (a chloro group), a bromine atom (a bromo group), and an iodine atom (an iodine group).

An alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, and an alkyl group having a carbon number of at least 1 and no greater than 3 as used herein each refer to an unsubstituted straight chain or branched chain alkyl group. Examples of the alkyl group having a carbon number of at least 1 and no greater than 8 include a methyl group, an ethyl group, an n-propyl group, an isopropyl group, an n-butyl group, a sec-butyl group, a tert-butyl group, an n-pentyl group, an isopentyl group, a neopentyl group, a 1,1-dimethylpropyl group, a 1,2-dimethylpropyl group, a straight chain or branched chain hexyl group, a straight chain or branched chain heptyl group, and a straight chain or branched chain octyl group. Out of the chemical groups listed as examples of the alkyl group having a carbon number of at least 1 and no greater than 8, the chemical groups having a carbon number of at least 1 and no greater than 6 are examples of the alkyl group having a carbon number of at least 1 and no greater than 6, the chemical groups having a carbon number of at least 1 and no greater than 5 are examples of the alkyl group having a carbon number of at least 1 and no greater than 5, the chemical groups having a carbon number of at least 1 and no greater than 4 are examples of the alkyl group having a carbon number of at least 1 and no greater than 4, and the chemical groups having a carbon number of at least 1 and no greater than 3 are examples of the alkyl group having a carbon number of at least 1 and no greater than 3.

An alkoxy group having a carbon number of at least 1 and no greater than 4 as used herein refers to an unsubstituted straight chain or branched chain alkoxy group. Examples of the alkoxy group having a carbon number of at least 1 and no greater than 4 include a methoxy group, an ethoxy group, an n-propoxy group, an isopropoxy group, an n-butoxy group, a sec-butoxy group, and a tert-butoxy group. Through the above, the terms used in the present description have been described.

[Image Forming Apparatus According to First Embodiment]

The following describes a first embodiment of the present invention with reference to the accompanying drawings. Note that elements in the drawings that are the same or equivalent are marked by the same reference signs and description thereof is not repeated. In the first embodiment, an X-axis, a Y-axis, and a Z-axis are perpendicular to one another. The X axis and the Y axis are parallel with a horizontal plane, and the Z axis is parallel with a vertical line.

The following first describes an overview of an image forming apparatus 1 according to the first embodiment with reference to FIG. 1. The image forming apparatus 1 according to the first embodiment is a full-color printer. The image forming apparatus 1 includes a feeding section 10, a conveyance section 20, an image forming section 30, a toner supply section 60, and an ejection section 70.

The feeding section 10 includes a cassette 11 that accommodates a plurality of sheets P. The feeding section 10 feeds the sheets P from the cassette 11 to the conveyance section 20. The sheets P are paper or made from a synthetic resin, for example. The conveyance section 20 conveys each sheet P to the image forming section 30.

The image forming section 30 includes a light exposure device 31, a magenta-color unit (also referred to below as an M unit) 32M, a cyan-color unit (also referred to below as a C unit) 32C, a yellow-color unit (also referred to below as a Y unit) 32Y, a black-color unit (also referred to below as a BK unit) 32BK, a transfer belt 33, a secondary transfer roller 34, and a fixing device 35. Each of the M unit 32M, the C unit 32C, the Y unit 32Y, and the BK unit 32BK includes a photosensitive member 50, a charging roller 51, a development roller 52, a primary transfer roller 53, a static elimination lamp 54, and a cleaner 55.

The light exposure device 31 irradiates each of the M unit 32M, the C unit 32C, the Y unit 32Y, and the BK unit 32BK with light based on image data to form an electrostatic latent image in each of the M unit 32M, the C unit 32C, the Y unit 32Y, and the BK unit 32BK. The M unit 32M forms a magenta toner image based on the electrostatic latent image. The C unit 32C forms a cyan toner image based on the electrostatic latent image. The Y unit 32Y forms a yellow toner image based on the electrostatic latent image. The BK unit 32BK forms a black toner image based on the electrostatic latent image.

Each pf the photosensitive members 50 is drum-shaped. Each photosensitive member 50 rotates about a rotational center 50X (rotation axis, see FIG. 2) thereof. The charging roller 51, the development roller 52, the primary transfer roller 53, the static elimination lamp 54, and the cleaner 55 are arranged around the photosensitive member 50 in the stated order from upstream in terms of a rotational direction R (see FIG. 2) of the photosensitive member 50. The charging roller 51 charges a circumferential surface 50*a* of the photosensitive member 50 to a positive polarity. As already described, the light exposure device 31 exposes the charged circumferential surfaces 50*a* of the photosensitive members 50 to light to form electrostatic latent images on the circumferential surfaces 50*a* of the photosensitive members 50. The development roller 52 carries a carrier CA supporting a toner T thereon by attracting the carrier CA thereto by magnetic force. Application of a developing bias (developing voltage) to the development rollers 52 generates a potential difference between the potential of the development rollers 52 and the potential of the circumferential surfaces 50*a* of the photosensitive members 50 to move and attach the toner T to the electrostatic latent images formed on the circumferential surfaces 50*a* of the photosensitive members 50. In this manner, the development rollers 52 supply the toner T to the electrostatic latent images to develop the electrostatic latent images into toner images. Through development, the toner images are formed on the circumferential surfaces 50*a* of the photosensitive members 50. The toner images each include the toner T. The transfer belt 33 is in contact with the circumferential surfaces 50*a* of the photosensitive members 50. The primary transfer rollers 53 primarily transfer the toner images formed on the circumferential surfaces 50*a* of the photosensitive members 50 to the transfer belt 33 (more specifically, the outer surface of the transfer belt 33). The toner images in the four colors are superimposed on and primarily transferred to the outer surface of the transfer belt 33. The toner images in the four colors include the toner image in the magenta color, the toner image in the cyan color, the toner image in the yellow color, and the toner image in the black color. Through primary transfer, a color toner image is formed on the outer surface of the transfer belt 33. The secondary transfer roller 34 secondarily transfers the color toner image formed on the outer surface of the transfer belt 33 to the sheet P. The fixing device 35 applies heat and pressure to the sheet to fix the color toner image to the sheet P. The sheet P with the color toner image fixed thereto is ejected onto the ejection section 70. After primary transfer, the static elimination lamps 54 included in the M unit 32M, the C unit 32C, the Y unit 32Y, and the BK unit 32BK perform static elimination on the circumferential surfaces 50*a* of the photosensitive members 50. After primary transfer (more specifically, after primary transfer and static elimination), the cleaners 55 collect toner T remaining on the circumferential surfaces 50*a* of the photosensitive members 50.

The toner supply section 60 includes a cartridge 60M accommodating a toner T in a magenta color, a cartridge 60C accommodating a toner T in a cyan color, a cartridge 60Y accommodating a toner T in a yellow color, and a cartridge 60BK accommodating a toner T in a black color. The cartridge 60M, the cartridge 60C, the cartridge 60Y, and the cartridge 60BK respectively supply the toners T to the development rollers 52 of the M unit 32M, the C unit 32C, the Y unit 32Y, and the BK unit 32BK.

Note that the photosensitive members 50 are each equivalent to what may be referred to as an image bearing member. The charging rollers 51 are each equivalent to what may be referred to as a charger. The development rollers 52 are each equivalent to what may be referred to as a development device. The primary transfer rollers 53 are each equivalent to what may be referred to as a primary transfer device. The secondary transfer roller 34 is equivalent to what may be referred to as a secondary transfer device. The static elimination lamps 54 are each equivalent to what may be referred to as a static elimination device. The cleaners 55 are each equivalent to what may be referred to as a cleaning device. The sheets P are each equivalent to what may be referred to as a recording medium.

Figure 2:
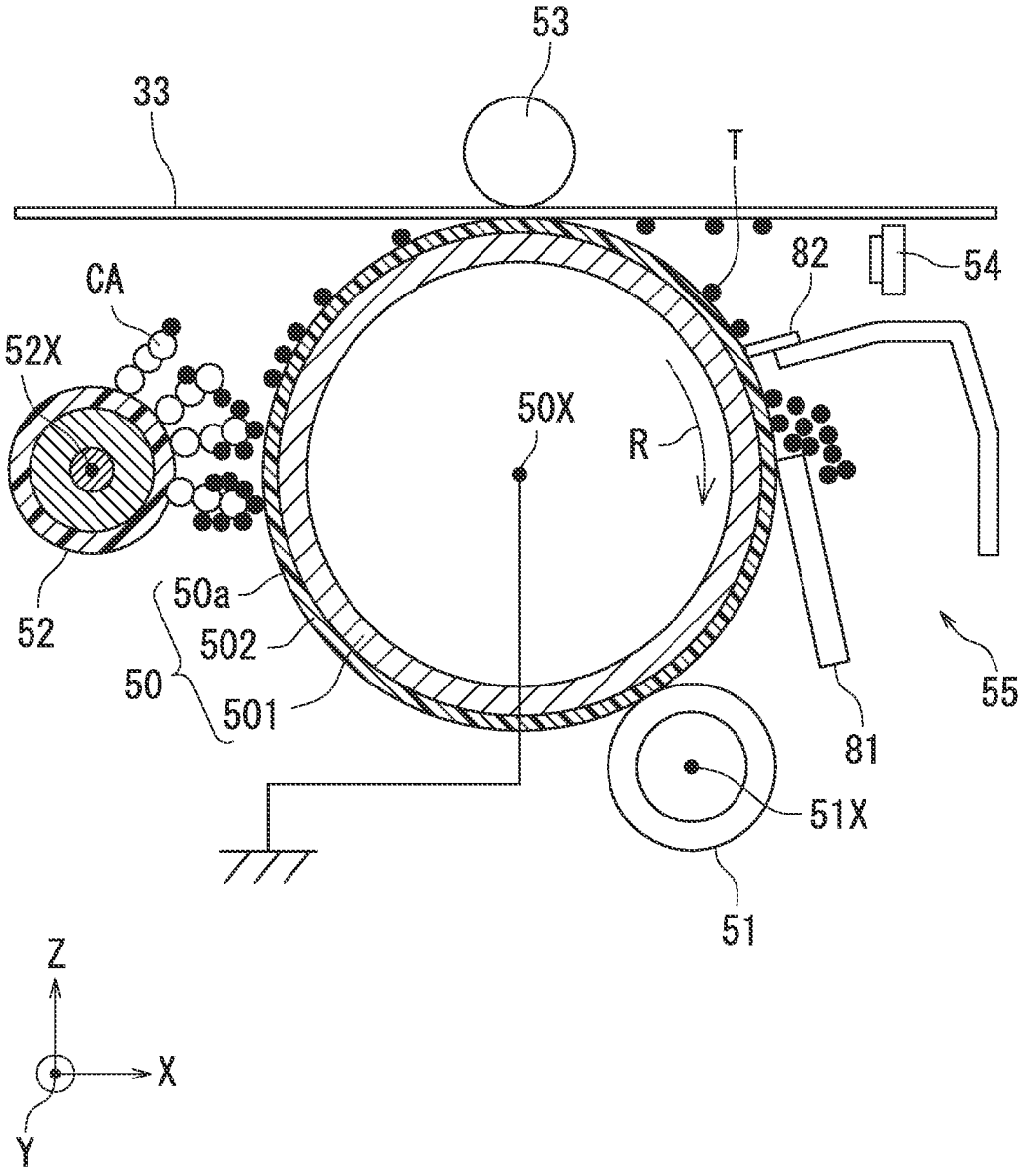
FIG. 2 is a diagram illustrating a photosensitive member included in the image forming apparatus illustrated in FIG. 1 and elements around the photosensitive member.

The following further describes the image forming apparatus 1 according to the first embodiment with reference to FIG. 2. FIG. 2 illustrates the photosensitive member 50 and elements around the photosensitive member 50. The image forming apparatus 1 according to the first embodiment includes photosensitive members 50, charging rollers 51, a light exposure device 31, development rollers 52, a transfer belt 33, primary transfer rollers 53, a secondary transfer roller 34, and cleaners 55. Each of the cleaners 55 includes the cleaning blade 81 that is equivalent to what may be referred to as a cleaning member. The cleaning blades 81 are pressed against the circumferential surfaces 50*a* of the photosensitive members 50 and collect residual toner T remaining on the circumferential surfaces 50*a* of the photosensitive members 50 as a result of the toner image being primarily transferred. With the image forming apparatus 1 according to the first embodiment, the following first and second advantages can be obtained.

The following describes the first advantage first. In order to form high-definition images, the image forming apparatus 1 is preferably designed so that a slight potential difference in the circumferential surface 50*a* of the photosensitive member 50 is reflected in difference in image density in an output image (image formed on the sheet P). However, such design tends to cause a ghost image on the output image. The ghost image refers to a phenomenon described as appearance of a residual image along with an output image, which in other words is reappearance of an image formed during a previous rotation of the photosensitive member 50. Non-uniform charging of the circumferential surface 50*a* of the photosensitive member 50 is caused for example due to variation in charge injection to a photosensitive layer 502 of the photosensitive member 50, presence of residual charge inside the photosensitive layer 502, or non-uniform current flowing at transfer due to presence or absence of a toner image on the photosensitive layer 502. Such non-uniform charging causes a ghost image to occur.

Figure 3:
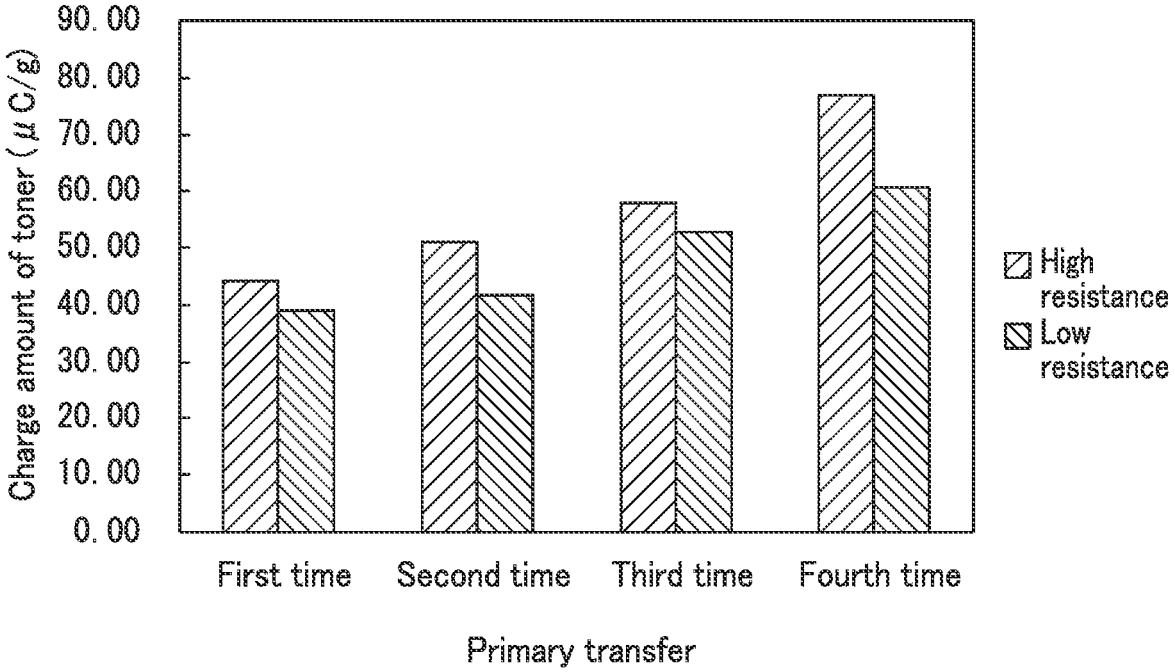
FIG. 3 is a graph representation explaining toner charge-up.

In order to inhibit occurrence of a ghost image, the transfer belt 33 is preferably set to have a high surface resistivity ρS (e.g., greater than 11 Log Ω). Transfer current flowing in the circumferential surface 50*a* of the photosensitive member 50 from the primary transfer roller 53 through the transfer belt 33 decreases as the surface resistivity ρS of the transfer belt 33 is increased. As such, non-uniform flowing of the transfer current is inhibited that depends on presence or absence of a toner image on the photosensitive layer 502. However, charge-up of the toner T tends to occur more readily as the surface resistivity ρS of the transfer belt 33 is increased. Charge-up of the toner T refers to a phenomenon in which a toner T on a transfer belt is charged to a charge amount over a desired value. The following describes charge-up of the toner T with reference to FIG. 3. The graph representation of FIG. 3 illustrates a relationship between the number of times of primary transfer of the toner T on the transfer belt 33 and charge amount of the toner T when the toners T in the four colors are primarily transferred onto the transfer belt in a sequential manner using an image forming apparatus of a reference example. As illustrated in FIG. 3, the charge amount of the toner T on the transfer belt 33 increases with an increase in the number of times of primary transfer of the toner T on the transfer belt 33. As further illustrated in FIG. 3, the charge amount of the toner T on the transfer belt tends to increase in a case with the transfer belt 33 having a high surface resistivity ρS as compared to a case with a transfer belt 33 having a low surface resistivity ρS (low resistance).

In view of the foregoing, in the first embodiment, the transfer belt 33 is set to have a low surface resistivity ρS (e.g., at least 6 Log Ω and no greater than 11 Log Ω) in order to inhibit occurrence of charge-up of the toner T. Furthermore, the present inventors extensively studied upon a photosensitive member 50 that is capable of inhibiting occurrence of a ghost image even if the transfer belt 33 has a low resistivity ρS. As a result of the study, the inventors found that occurrence of a ghost image can be inhibited as long as the photosensitive member 50 satisfies formula (1) described below even if the transfer belt 33 has a low surface resistivity ρS (e.g., at least 6 Log Ω and no greater than 11 Log Ω).

The following describes the second advantage. In a case of a toner T having a small particle diameter (e.g., a volume median diameter of at least 4.0 μm and no greater than 7.0 μm) and a high roundness (e.g., a roundness of at least 0.960 and no greater than 0.998), the toner T easily passes through a gap between the cleaning blade 81 and the circumferential surface 50*a* of the photosensitive member 50, tending to cause insufficient cleaning. In view of the foregoing, in the image forming apparatus 1 according to the first embodiment, the linear pressure of the cleaning blade 81 on the circumferential surface 50*a* of the photosensitive member 50 is set to at least 10 N/m and no greater than 40 N/m. As a result of each cleaning blade 81 being tightly pressed against the corresponding photosensitive member 50 at a linear pressure in the above-specified range, it is possible to eliminate or extremely reduce the gap between the cleaning blade 81 and the circumferential surface 50*a* of the photosensitive member 50. This can enable favorable cleaning on the circumferential surface 50*a* of the photosensitive member 50 even using a toner T having a small particle diameter and a high roundness.

However, the present inventors' study has revealed that a higher linear pressure (e.g., a linear pressure of at least 10 N/m and no greater than 40 N/m) of the cleaning blade 81 on the circumferential surface 50*a* of the photosensitive member 50 is more likely to lead to occurrence of a ghost image.

The present inventors' study has also revealed that occurrence of a ghost image is more significant in a case of the photosensitive member 50 having the photosensitive layer 502, which is a single-layer photosensitive layer, than in a case of a photosensitive member having a multi-layer photosensitive layer. The photosensitive layer 502 of a single-layer is relatively thick. The thicker the photosensitive layer 502 is, the more easily electrons and holes generated from a charge generating material are trapped by residual charge in the photosensitive layer 502. The trapped electrons and holes prevent the photosensitive member 50 from being uniformly charged, causing a ghost image.

The present inventors therefore made intensive study upon a photosensitive member 50 capable of inhibiting occurrence of a ghost image even if the linear pressure of the cleaning blade 81 on the circumferential surface 50*a* of the photosensitive member 50 is high (e.g., a linear pressure of at least 10 N/m and no greater than 40 N/m) and the photosensitive member 50 has the photosensitive layer 502 of a single layer. The present inventors then found that occurrence of a ghost image can be inhibited as long as the photosensitive member 50 satisfies formula (1) described below even if the linear pressure of the cleaning blade 81 is at least 10 N/m and no greater than 40 N/m and the photosensitive member 50 has the photosensitive layer 502 of a single layer.

<Photosensitive Member>

Figure 4:
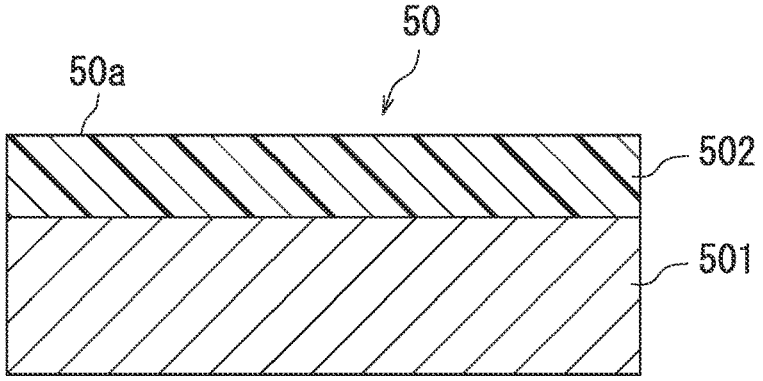
FIG. 4 is a partial cross-sectional view of an example of the photosensitive member included in the image forming apparatus illustrated in FIG. 1.
Figure 5:
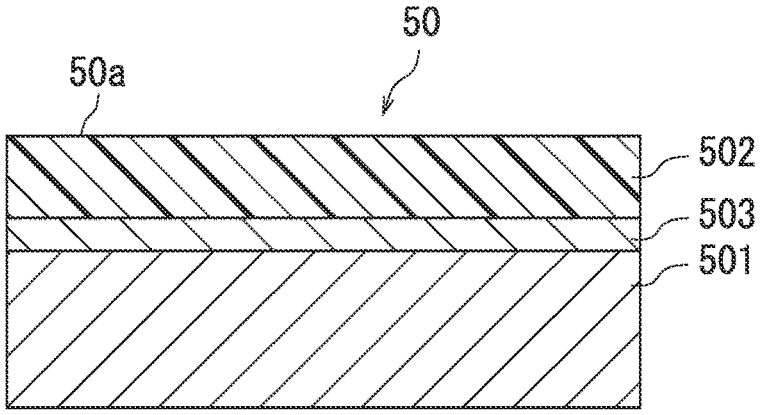
FIG. 5 is a partial cross-sectional view of an example of the photosensitive member included in the image forming apparatus illustrated in FIG. 1.
Figure 6:
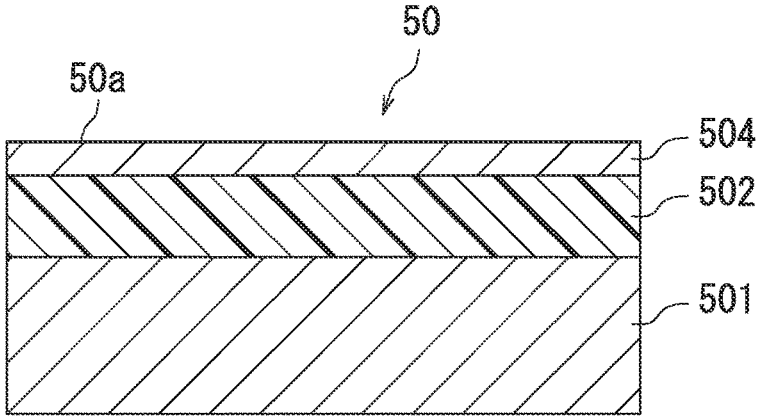
FIG. 6 is a partial cross-sectional view of an example of the photosensitive member included in the image forming apparatus illustrated in FIG. 1.

The following describes the photosensitive member 50 included in the image forming apparatus 1 with reference to FIGS. 4 to 6. FIGS. 4 to 6 are each a partial cross-sectional view of an example of the photosensitive member 50. The photosensitive member 50 is an organic photoconductor (OPC) drum, for example.

As illustrated in FIG. 4, the photosensitive member 50 includes a conductive substrate 501 and a photosensitive layer 502, for example. The photosensitive layer 502 is a single layer (one layer). The photosensitive member 50 is a single-layer electrophotographic photosensitive member including a photosensitive layer 502 of a single layer. The photosensitive layer 502 contains a charge generating material, a hole transport material, an electron transport material, and a binder resin. No particular limitations are placed on film thickness of the photosensitive layer 502, but the film thickness of the photosensitive layer 502 is preferably at least 5 μm and no greater than 100 μm, more preferably at least 10 μm and no greater than 50 μm, further preferably at least 10 μm and no greater than 35 μm, and yet further preferably at least 15 μm and no greater than 30 μm.

As illustrated in FIG. 5, the photosensitive member 50 may include the conductive substrate 501, the photosensitive layer 502, and an intermediate layer 503 (undercoat layer). The intermediate layer 503 is provided between the conductive substrate 501 and the photosensitive layer 502. As illustrated in FIG. 4, the photosensitive layer 502 may be provided directly on the conductive substrate 501. Alternatively, the photosensitive layer 502 may be provided on the conductive substrate 501 with the intermediate layer 503 therebetween as illustrated in FIG. 5. The intermediate layer 503 may be a single layer or a plurality of layers.

As illustrated in FIG. 6, the photosensitive member 50 may include the conductive substrate 501, the photosensitive layer 502, and a protective layer 504. The protective layer 504 is provided on the photosensitive layer 502. The protective layer 504 may be a single layer or a plurality of layers.

(Chargeability Ratio)

The photosensitive member 50 satisfies formula (1) shown below.

$$0.60 \leqq \frac{V}{(Q/S)\times(d/\varepsilon_r\cdot\varepsilon_0)} \tag{1}$$

In formula (1), Q represents a charge amount (unit: C) of the photosensitive member 50. S represents a charge area (unit: $m^2$) of the photosensitive member 50. d represents a film thickness (unit: m) of the photosensitive layer 502 of the photosensitive member 50. $\varepsilon_r$ represents a specific permittivity of the binder resin contained in the photosensitive layer 502 of the photosensitive member 50. $\varepsilon_0$ represents the vacuum permittivity (unit: F/m). Note that "$d/\varepsilon_r\cdot\varepsilon_0$" means "$d/(\varepsilon_r\times\varepsilon_0)$". V represents a value calculated according to equation (2) shown below.

$$V=V_0-V_r \tag{2}$$

In equation (2), $V_r$ represents a first potential of the circumferential surface 50*a* of the photosensitive member 50 yet to be charged by the charging roller 51. $V_0$ in equation (2) represents a second potential of the circumferential surface 50*a* of the photosensitive member 50 charged by the charging roller 51.

In the following, a value represented by the following expression (1') in formula (1) is also referred to below as a chargeability ratio. The chargeability ratio represented by expression (1') is a ratio of actual chargeability (a measured value) of the photosensitive member 50 to theoretical chargeability (a theoretical value) of the photosensitive member 50 when the circumferential surface 50*a* of the photosensitive member 50 is charged by the charging roller 51. Details of the ratio of the actual chargeability of the photosensitive member 50 to the theoretical chargeability of the photosensitive member 50 will be described later with reference to FIG. 8.

$$\frac{V}{(Q/S)\times(d/\varepsilon_r\cdot\varepsilon_0)} \tag{1'}$$

As a result of the photosensitive member 50 satisfying formula (1), the following third, fourth, and fifth advantages can be obtained. The following describes the third advantage first. As already described, a ghost image is more likely to occur as the linear pressure of the cleaning blade 81 on the circumferential surface 50*a* of the photosensitive member 50 is increased (e.g., a linear pressure of at least 10 N/m and no greater than 40 N/m). However, as a result of the photosensitive member 50 satisfying formula (1), chargeability of the photosensitive member 50 is close to the theoretical value to enable uniform charging of the circumferential surface 50*a* of the photosensitive member 50. Thus, occurrence of a ghost image can be inhibited even if the linear pressure of the cleaning blade 81 is at least 10 N/m and no greater than 40 N/m.

The following describes the fourth advantage. The photosensitive layer 502 of the photosensitive member 50 may abrade away in the course of repeated image formation. One of causes of abrasion of the photosensitive layer 502 is abrasion due to discharge from the charging roller 51 to the photosensitive member 50, for example. Chargeability of the photosensitive member 50 that satisfies formula (1) is close to the theoretical value. This can achieve favorable charging of the circumferential surface 50*a* of the photosensitive member 50 even if the amount of discharge from the charging roller 51 to the photosensitive member 50 is set low. Setting the discharge amount low can reduce the abrasion amount of the photosensitive layer 502. Furthermore, reduction in abrasion amount of the photosensitive layer 502 can allow the film thickness of the photosensitive layer 502 to be set thin, thereby enabling reduction in the manufacturing cost.

The following describes the fifth advantage. As a result of the photosensitive member 50 satisfying formula (1), chargeability of the photosensitive member 50 is close to the theoretical value to enable favorable charging of the circumferential surface 50*a* of the photosensitive member 50 even if current flowing in the charging roller 51 is set low. As a result of the current flowing in the charging roller 51 being set low, decrease in conductivity of the material (e.g., rubber) of the charging roller 51, which is caused due to conduction, can be inhibited. As described as the first advantage, it is possible to inhibit occurrence of a ghost image even if the linear pressure of the cleaning blade 81 is high (at least 10 N/m and no greater than 40 N/m) as long as the photosensitive member 50 satisfies formula (1).

Because the linear pressure can be high, an external additive of the toner T is prevented from easily passing through the gap between the cleaning blade 81 and the circumferential surface 50*a* of the photosensitive member 50. As a result of the additive being prevented from easily passing through the gap, the external additive is prevented from easily adhering to the surface of the charging roller 51. Because conductivity of the material of the charging roller 51 can be prevented from decreasing and the external additive is prevented from easily adhering to the surface of the charging roller 51, it is possible to prevent elevation of resistance of the charging roller 51.

As to formula (1), the chargeability ratio is preferably at least 0.70 in order to inhibit occurrence of a ghost image, more preferably at least 0.80, and further preferably at least 0.90. The measured value of chargeability of the photosensitive member 50 is equal to the theoretical value thereof when the chargeability ratio is 1.00. That is, the chargeability ratio is no greater than 1.00.

A chargeability ratio measuring method will be described next. In formula (1), V represents a value calculated according to the aforementioned equation (2). The following describes a method for measuring the first potential $V_r$ and the second potential $V_0$ in equation (2) with reference to FIG. 7. Note that the first potential $V_r$ and the second potential $V_0$ are measured under environmental conditions of a temperature of 23° C. and a relative humidity of 50%.

Figure 7:
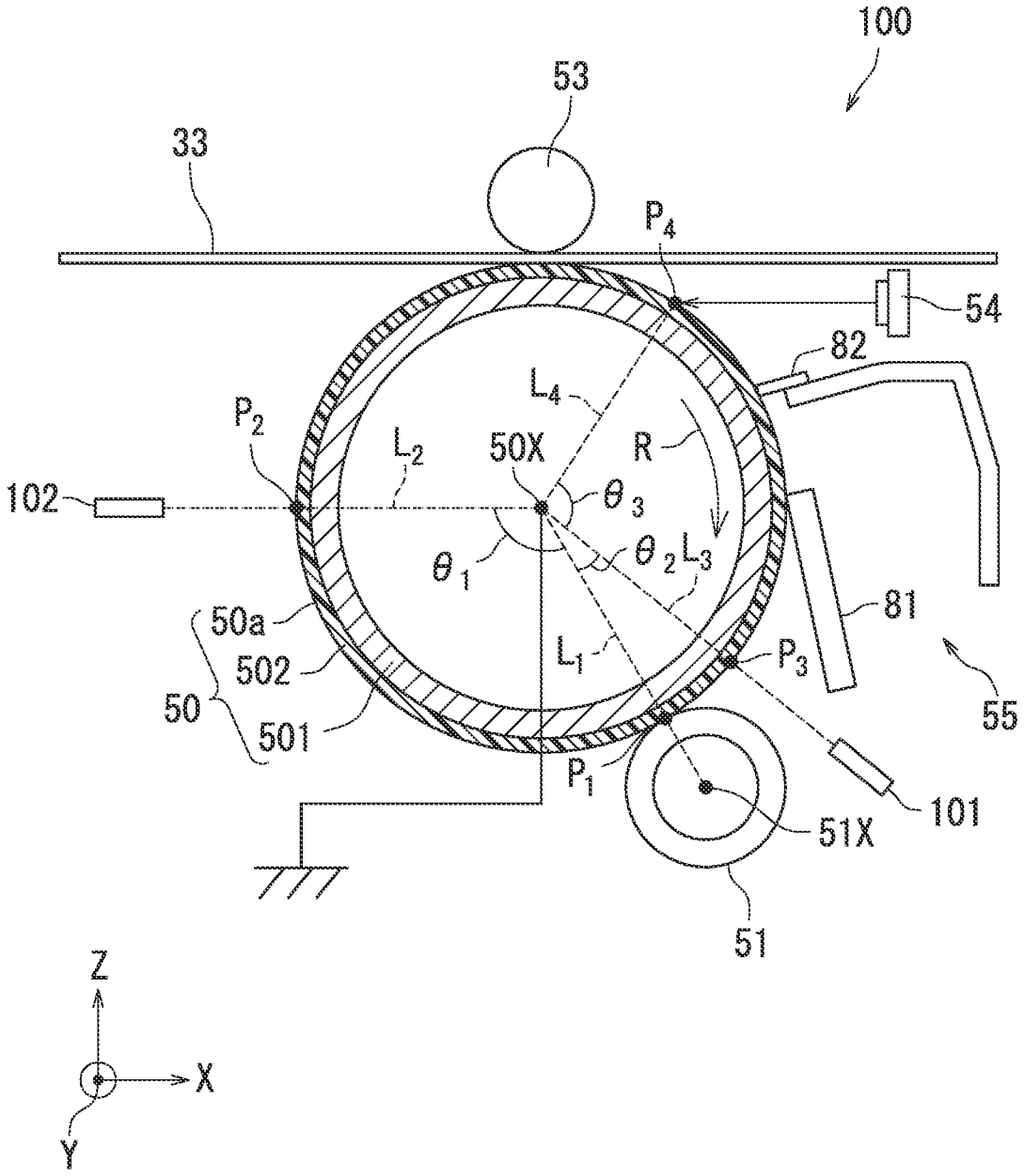
FIG. 7 is a diagram illustrating a measuring device for measuring a first potential $V_r$ and a second potential $V_0$.

The first potential $V_r$ and the second potential $V_0$ can be measured using a measuring device 100 illustrated in FIG. 7. The measuring device 100 can be fabricated by performing first modification and second modification on the image forming apparatus 1. In the first modification, a first voltage probe 101 is attached to the image forming apparatus 1. The first voltage probe 101 is placed on the upstream side of the charging roller 51 in terms of the rotational direction R of the photosensitive member 50. The first voltage probe 101 is connected to a first surface electrometer (not illustrated, "ELECTROSTATIC VOLTMETER Model 344", product of TREK, INC.). In the second modification, a development roller 52 of the image forming apparatus 1 is replaced by a second voltage probe 102. The second voltage probe 102 is placed at a location where a rotational center 52X (rotation axis) of the development roller 52 has been located. The second voltage probe 102 is connected to a second surface electrometer (not illustrated, "ELECTROSTATIC VOLTMETER Model 344", product of TREK, INC.).

The measuring device 100 includes at least a charging roller 51, the second voltage probe 102, a static elimination lamp 54, and the first voltage probe 101. The photosensitive member 50 that is a measurement target is set in the measuring device 100. The charging roller 51, the second voltage probe 102, the static elimination lamp 54, and the first voltage probe 101 are arranged around the photosensitive member 50 in the stated order from upstream in terms of the rotational direction R of the photosensitive member 50.

The second voltage probe 102 is placed so that an angle $\theta_1$ between a first line $L_1$ and a second line $L_2$ is 120 degrees. Here, the first line $L_1$ is a line connecting the rotational center 50X (rotation axis) of the photosensitive member 50 and a rotational center 51X (rotation axis) of the charging roller 51, and the second line $L_2$ is a line connecting the rotational center 50X (rotation axis) of the photosensitive member 50 and the second voltage probe 102. The intersection point of the first line $L_1$ and the circumferential surface 50*a* of the photosensitive member 50 is a charge point $P_1$. The intersection point of the second line $L_2$ and the circumferential surface 50*a* of the photosensitive member 50 is a development point $P_2$.

The first voltage probe 101 is placed so that an angle $\theta_2$ between a third line $L_3$ and the first line $L_1$ is 20 degrees. Here, the third line $L_3$ is a line connecting the rotational center 50X (rotation axis) of the photosensitive member 50 and the first voltage probe 101, and the first line $L_1$ is the line connecting the rotational center 50X (rotation axis) of the photosensitive member 50 and the rotational center 51X (rotation axis) of the charging roller 51. The intersection point of the third line $L_3$ and the circumferential surface 50*a* of the photosensitive member 50 is a pre-charge point $P_3$.

The point of the circumferential surface 50*a* of the photosensitive member 50 where static elimination light of the static elimination lamp 54 is radiated is a static elimination point $P_4$. The static elimination lamp 54 is placed so that an angle $\theta_3$ between a fourth line $L_1$ and the third line $L_3$ is 90 degrees. Here, the fourth line $L_4$ is a line connecting the rotational center 50X (rotation axis) of the photosensitive member 50 and the static elimination point $P_4$, and the third line $L_3$ is the line connecting the rotational center 50X (rotation axis) of the photosensitive member 50 and the first voltage probe 101. Note that a modified version of a multifunction peripheral ("TASKalfa356Ci", product of KYOCERA Document Solutions Inc.) can be used as the measuring device 100.

In measurement of the first potential $V_r$ and the second potential $V_0$, a charging voltage applied to the charging roller 51 is set to any of +1000 V, +1100 V, +1200 V, +1300 V, +1400 V, and +1500 V. Alight quantity of the static elimination light emitted from the static elimination lamp 54 when the static elimination light reaches the circumferential surface 50*a* of the photosensitive member 50 (also referred to below as a static elimination light intensity) is set to 5 J/cm$^2$. The first potential $V_r$ and the second potential $V_0$ are measured while the photosensitive member 50 is rotated about the rotational center 50X (rotation axis). The charging roller 51 charges the circumferential surface 50*a* of the photosensitive member 50 to a positive polarity at the charge point $P_1$ of the photosensitive member 50. Next, the static elimination lamp 54 performs static elimination on the circumferential surface 50*a* of the photosensitive member 50 at the static elimination point $P_4$ of the photosensitive member 50. The first potential $V_r$ and the second potential $V_0$ are measured simultaneously at the time when the photosensitive member 50 has been rotated 10 rounds (also referred to below as a timing K) while charging and static elimination as above are performed. Specifically, the potential (first potential $V_r$) of the circumferential surface 50*a* of the photosensitive member 50 is measured at the pre-charge point $P_3$ of the photosensitive member 50 at the timing K using the first voltage probe 101. Also, the potential (second potential $V_0$) of the circumferential surface 50*a* of the photosensitive member 50 is measured at the development point $P_2$ of the photosensitive member 50 at the timing K using the second voltage probe 102. In a manner as described above, the first potential $V_r$ and the second potential $V_0$ are measured under each of conditions of charging voltages applied to the charging roller 51 of +1000 V, +1100 V, +1200 V, +1300 V, +1400 V, and +1500 V.

Note that light exposure by a light exposure device 31, development by a development roller 52, primary transfer by a primary transfer roller 53, and cleaning by a cleaning blade 81 are not performed in measurement of the first potential $V_r$ and the second potential $V_0$. The cleaning blade 81 is set to have a linear pressure of 0 N/m. The method for measuring the first potential $V_r$ and the second potential $V_0$ in equation (2) has been described so far. The chargeability ratio measuring method will be described further.

The charge amount Q in formula (1) is measured under environmental conditions of a temperature of 23° C. and a relative humidity of 50%. The charge amount Q is measured according to the following method at measurement of the first potential $V_r$ and the second potential $V_0$. At the timing K of the simultaneous measurement of the first potential $V_r$ and the second potential $V_0$, a current $E_1$ flowing through the charging roller 51 is measured using an ammeter/voltmeter ("MINIATURE PORTABLE AMMETER AND VOLTMETER 2051", product of Yokogawa Test & Measurement Corporation). The current $E_1$ is measured under each of conditions of charging voltages applied to the charging roller 51 of +1000 V, +1100 V, +1200 V, +1300 V, +1400 V, and +1500 V. The charge amount Q under each of the conditions of charging voltages applied to the charging roller 51 of +1000 V, +1100 V, +1200 V, +1300 V, +1400 V, and +1500 V is calculated from the measured currents $E_t$ in accordance with equation (3) shown below.

$$\text{Charge amount } Q = \text{current } E_1(\text{unit:A}) \times \text{charging time } t\ (\text{unit:second}) \tag{3}$$

Note that a high-voltage substrate (not illustrated) of the measuring device 100 is connected to the charging roller 51 via the ammeter/voltmeter. The current $E_t$ flowing in the charging roller 51 and the charging voltage mentioned in association with the measurement of the first potential $V_r$ and the second potential $V_0$ can be constantly monitored using the ammeter/voltmeter while the measuring device 100 is in operation.

The charge area S in formula (1) is an area of a charged region of the circumferential surface 50*a* of the photosensitive member 50 charged by the charging roller 51. The charge area S is calculated in accordance with the following equation (4). A charge width in equation (4) is a length of the charged region of the circumferential surface 50*a* of the photosensitive member 50 charged by the charging roller 51 in a longitudinal direction (a rotational axis direction D in FIG. 10) of the photosensitive member 50.

$$\text{Charge area } S\ (\text{unit:m}^2) = \text{linear velocity of photosensitive member 50 (unit: m/second)} \times \text{charge width (m)} \times \text{charging time } t\ (\text{unit:second}) \tag{4}$$

A value "V" in formula (1) is calculated from the first potential $V_r$ and the second potential $V_0$ each measured according to the above-described method. A value of "Q/S" in formula (1) is calculated from the charge amount Q and the charge area S measured according to the above-described methods. A graph is then produced with "Q/S" value on a horizontal axis and "V" value on a vertical axis. Six points are plotted in the graph, indicating measurement results obtained under the conditions of charging voltages applied to the charging roller 51 of +1000 V, +1100 V, +1200 V, +1300 V, +1400 V, and +1500 V. An approximate straight line on these six points is drawn. A gradient of the approximate straight line is determined from the approximate straight line. The determined gradient is taken to be "V/(Q/S)" in formula (1).

A film thickness d of the photosensitive layer 502 in formula (1) is measured under environmental conditions of a temperature of 23° C. and a relative humidity of 50%. The film thickness d of the photosensitive layer 502 is measured using a film thickness measuring device ("FISCHERSCOPE (registered Japanese trademark) MMS (registered Japanese trademark)", product of Helmut Fischer GmbH). Note that the film thickness of the photosensitive layer 502 is set to $30\times10^{-6}$ in the first embodiment.

$\varepsilon_0$ in formula (1) represents the vacuum permittivity. The vacuum permittivity $\varepsilon_0$ is constant and is $8.85\times10^{-12}$ (unit: F/m).

The specific permittivity $\varepsilon_r$ of the binder resin in formula (1) is equivalent to a specific permittivity of the photosensitive layer 502 on the assumption that no charge is trapped inside the photosensitive layer 502 and the whole amount of charge supplied from the charging roller 51 is changed to the potential (surface potential) of the circumferential surface 50*a* of the photosensitive member 50. The specific permittivity εr of the binder resin is measured using a photosensitive member for specific permittivity measurement. The photosensitive member for specific permittivity measurement includes a photosensitive layer only containing the binder resin. Note that the photosensitive member for specific permittivity measurement can be produced according to the same method as in production of photosensitive members described in association with Examples below in all aspects other than that none of a charge generating material, a hole transport material, an electron transport material, and an additive is added thereto. The specific permittivity $\varepsilon_r$ of the binder resin is calculated using the photosensitive member for specific permittivity measurement as a measurement target in accordance with equation (5) shown below. The specific permittivity $\varepsilon_r$ of the binder resin calculated in accordance with equation (5) is 3.5 in the first embodiment.

$$V_\varepsilon = \frac{(Q_\varepsilon/S_\varepsilon)\times d_\varepsilon}{\varepsilon_r \times \varepsilon_0} \tag{5}$$

In equation (5), $Q_\varepsilon$ represents a charge amount (unit: C) of the photosensitive member for specific permittivity measurement. $S_\varepsilon$ represents a charge area (unit: $m^2$) of the photosensitive member for specific permittivity measurement. $d_\varepsilon$ represents a film thickness (unit: m) of a photosensitive layer of the photosensitive member for specific permittivity measurement. $\varepsilon_r$ represents a specific permittivity of the binder resin. $\varepsilon_0$ represent the vacuum permittivity (unit: F/m). $V_\varepsilon$ is a value calculated from the following expression "$V_{0\varepsilon}-V_{r\varepsilon}$". $V_{r\varepsilon}$ represents a third potential of the circumferential surface of the photosensitive member for specific permittivity measurement yet to be charged by the charging roller 51. $V_{0\varepsilon}$ represents a fourth potential of the circumferential surface of the photosensitive member for specific permittivity measurement charged by the charging roller 51.

The film thickness $d_\varepsilon$ in equation (5) is calculated according to the same method as in calculation of the film thickness d of the photosensitive member 50 in the above-described formula (1) in all aspects other than that the photosensitive member for specific permittivity measurement is used instead of the photosensitive member 50. In the first embodiment, the film thickness $d_\varepsilon$ in equation (5) is set to $30\times10^{-6}$ m. The vacuum permittivity $\varepsilon_\varepsilon$ in equation (5) is constant and is $8.85\times10^{-12}$ F/m. The theoretical value 0 V is substituted into the third potential $V_{r\varepsilon}$ in equation (5). The charge amount $Q_\varepsilon$ of the photosensitive member for specific permittivity measurement in equation (5) is measured according to the same method as in measurement of the charge amount Q of the photosensitive member 50 in formula (1) in all aspects other than that the photosensitive member for specific permittivity measurement is used instead of the photosensitive member 50 and the charging voltage is set to +1000 V. The charge area $S_\varepsilon$ of the photosensitive member for specific permittivity measurement in equation (5) is calculated according to the same method as in calculation of the charge area S of the photosensitive member 50 in formula (1) in all aspects other than that the photosensitive member for specific permittivity measurement is used instead of the photosensitive member 50. The fourth potential $V_{0\varepsilon}$ in equation (5) is measured according to the same method as in measurement of the second potential $V_0$ of the photosensitive member 50 in equation (2) in all aspects other than that the photosensitive member for specific permittivity measurement is used instead of the photosensitive member 50. Using the thus obtained values, the specific permittivity εr of the binder resin is calculated in accordance with equation (5).

The chargeability ratio measuring method has been described so far. The following further describes the chargeability ratio with reference to FIG. 8. As already described, the chargeability ratio is a ratio of actual chargeability (an actual measured value) of the photosensitive member 50 to theoretical chargeability (a theoretical value) of the photosensitive member 50 when the circumferential surface 50*a* of the photosensitive member 50 is charged by the charging roller 51. The chargeability as used in the present description indicates how much charge potential (unit: V) of the photosensitive member 50 increases for surface charge density (unit: $C/m^2$) of charge supplied from the charging roller 51. The theoretical chargeability (a theoretical value) of the photosensitive member 50 is a value on the assumption that the whole amount of charge supplied from the charging roller 51 to the photosensitive member 50 is changed to the charge potential of the photosensitive member 50. The charge potential of the photosensitive member 50 is equivalent to a difference between the potential (first potential $V_r$) of the circumferential surface 50*a* of the photosensitive member 50 before a portion of the circumferential surface 50*a* of the photosensitive member 50 passes the charging roller 51 and the potential (second potential $V_0$) of the circumferential surface 50*a* of the photosensitive member 50 after the portion of the circumferential surface 50*a* of the photosensitive member 50 has passed the charging roller 51.

Figure 8:
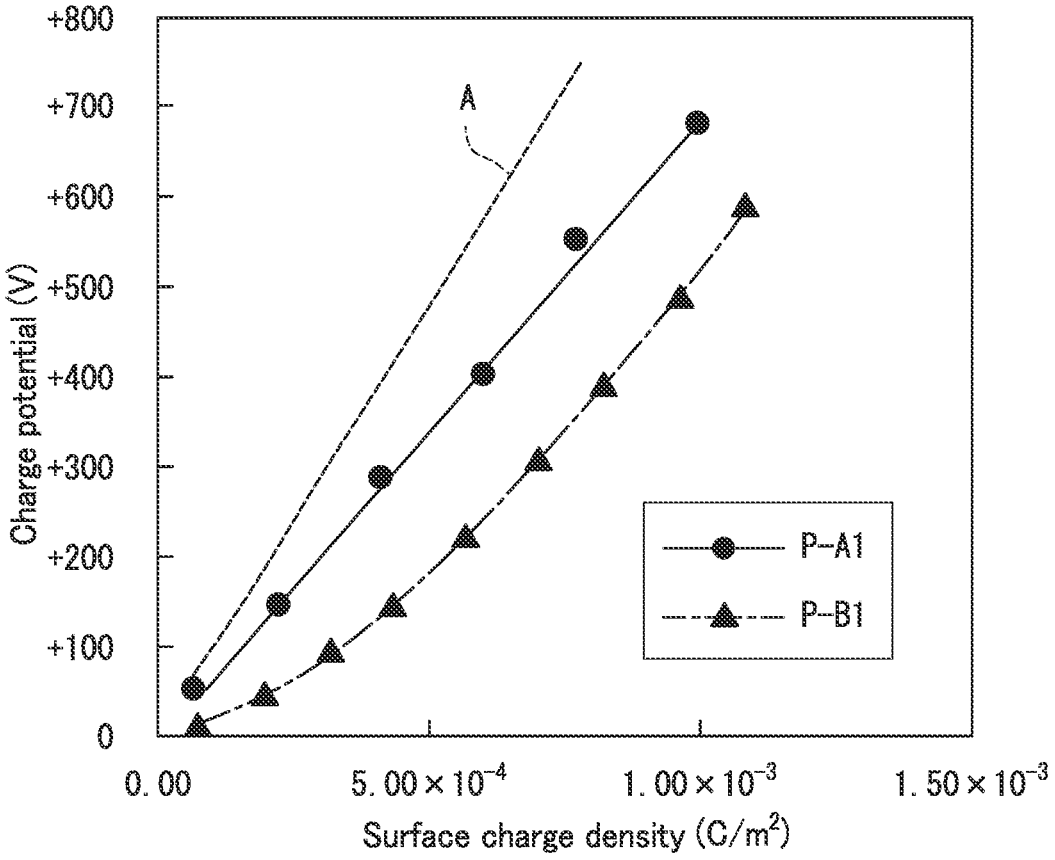
FIG. 8 is a graph representation illustrating a relationship between surface charge density and charge potential of photosensitive members.

FIG. 8 is a graph representation illustrating relationships between surface charge density (unit: $C/m^2$) and charge potential (unit: V) of photosensitive members. The horizontal axis in FIG. 8 indicates surface charge density. The surface charge density is a value corresponding to "Q/S" in formula (1). The vertical axis in FIG. 8 indicates charge potential. The charge potential is a value corresponding to "V" in formula (1). The chargeability corresponds to the gradient "V/(Q/S)" of each of graphs shown in FIG. 8.

Circles on the plot in FIG. 8 indicate measurement results of a photosensitive member (P-A1) having a chargeability ratio of at least 0.60. Triangles on the plot in FIG. 8 indicate measurement results of a photosensitive member (P-B1) having a chargeability ratio of less than 0.60. Note that the photosensitive members (P-A1) and (P-B1) are produced according to a method described in association with Examples. The dashed line A in FIG. 8 indicates the theoretical chargeability (theoretical value) of the photosensitive member 50. The theoretical chargeability (theoretical value) of the photosensitive member 50 is calculated in accordance with equation (6) shown below. The dashed line A in FIG. 8 is obtained by plotting values of "$Q_t/S_t$" in equation (6) on the horizontal axis and plotting values "$V_t$" in equation (6) on the vertical axis.

$$V_t = V_{0t} - V_{rt} = \frac{(Q_t/S_t)\times d_t}{\varepsilon_{rt}\times\varepsilon_o} \tag{6}$$

In equation (6), $Q_t$ represents a charge amount (unit: C) of the photosensitive member 50. $S_t$ represents a charge area (unit: $m^2$) of the photosensitive member 50. $d_t$ represents a film thickness (unit: m) of the photosensitive layer 502 of the photosensitive member 50. $\varepsilon_{rt}$ represents a specific permittivity of the binder resin contained in the photosensitive layer 502 of the photosensitive member 50. $\varepsilon_0$ represents the vacuum permittivity (unit: F/m). $V_t$ is a value calculated in accordance with expression "$V_{0t}-V_{rt}$". $V_{rt}$ represents a fifth potential of the circumferential surface 50*a* of the photosensitive member 50 yet to be charged by the charging roller 51. $V_{0t}$ represents a sixth potential of the circumferential surface 50*a* of the photosensitive member 50 charged by the charging roller 51.

The film thickness $d_t$ in equation (6) is calculated according to the same method as in calculation of the film thickness d of the photosensitive member 50 in formula (1). In the first embodiment, the film thickness di in equation (6) is set to $30\times10^{-6}$ m. The vacuum permittivity $\varepsilon_0$ in equation (6) is constant and is $8.85\times10^{-12}$ F/m. The theoretical value 0 V is substituted into the fifth potential $V_{rt}$ in equation (6). The charge amount $Q_t$ of the photosensitive member 50 in equation (6) is measured according to the same method as in measurement of the charge amount Q of the photosensitive member 50 in formula (1). The charge area $S_t$ of the photosensitive member 50 in equation (6) is calculated according to the same method as in calculation of the charge area S of the photosensitive member 50 in formula (1). The specific permittivity $\varepsilon_{rt}$ of the binder resin in equation (6) is measured according to the same method as in measurement of the specific permittivity $\varepsilon_r$ of the binder resin in formula (1). The specific permittivity $\varepsilon_{rt}$ of the binder resin in equation (6) is 3.5, the same as the specific permittivity $\varepsilon_{rt}$ of the binder resin in formula (1). Using the thus obtained values, the sixth potential $V_{0t}$ and $V_t$ are calculated in accordance with equation (6).

As shown in FIG. 8, the higher and closer to 1.00 the chargeability ratio is, the closer to the dashed line A the chargeability (corresponding to the gradient in FIG. 8) is. Occurrence of a ghost image can be sufficiently inhibited as long as the photosensitive member 50 has a chargeability ratio of at least 0.60. Through the above, the chargeability ratio of the photosensitive member 50 has been described. The following further describes the photosensitive member 50.

The circumferential surface 50*a* of the photosensitive member 50 has a surface friction coefficient of preferably at least 0.20 and no greater than 0.80, more preferably at least 0.20 and no greater than 0.60, and further preferably at least 0.20 and no greater than 0.52. As a result of the surface friction coefficient of the circumferential surface 50*a* of the photosensitive member 50 being no greater than 0.80, adhesion of the toner T to the circumferential surface 50*a* of the photosensitive member 50 can be low enough to further prevent insufficient cleaning. Furthermore, as a result of the surface friction coefficient of the circumferential surface 50*a* of the photosensitive member 50 being no greater than 0.80, friction force of the cleaning blade 81 on the circumferential surface 50*a* of the photosensitive member 50 can be low enough to further reduce abrasion of the photosensitive layer 502 of the photosensitive member 50. No particular limitations are placed on the lower limit of the surface friction coefficient of the circumferential surface 50*a* of the photosensitive member 50. The surface friction coefficient of the circumferential surface 50*a* of the photosensitive member 50 may for example be at least 0.20. The surface friction coefficient of the circumferential surface 50*a* of the photosensitive member 50 can be measured according to a method described in association with Examples.

In order to obtain output images favorable in image quality, the circumferential surface 50*a* of the photosensitive member 50 has a post-exposure potential of preferably +50

V or higher and +300 V or lower, and more preferably +80 V or higher and +200 V or lower. The post-exposure potential is a potential of a region of the circumferential surface 50*a* of the photosensitive member 50 exposed to light by the light exposure device 31. The post-exposure potential is measured after light exposure and before development. The post-exposure potential of the photosensitive member 50 can be measured according to a method described in association with Examples.

The photosensitive layer 502 has a Martens hardness of preferably at least 150 N/mm$^2$, more preferably at least 180 N/mm$^2$, further preferably at least 200 N/mm$^2$, and yet further preferably at least 220 N/mm$^2$. As a result of the photosensitive layer 502 having a Martens hardness of at least 150 N/mm$^2$, the abrasion amount of the photosensitive layer 502 is low enough to increase abrasion resistance of the photosensitive member 50. No particular limitations are placed on the upper limit of the Martens hardness of the photosensitive layer 502. For example, the Martens hardness of the photosensitive layer 502 may be no greater than 250 N/mm$^2$. The Martens hardness of the photosensitive layer 502 can be measured according to a method described in association with Examples.

The photosensitive layer 502 contains a charge generating material, a hole transport material, an electron transport material, and a binder resin. The photosensitive layer 502 may further contain an additive according to necessity. The following describes the charge generating material, the hole transport material, the electron transport material, the binder resin, the additive, and preferable material combinations.

(Charge Generating Material)

No particular limitations are placed on the charge generating material. Examples of the charge generating material include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. The photosensitive layer 502 may contain only one charge generating material or may contain two or more charge generating materials.

Examples of phthalocyanine-based pigments that are preferable in terms of inhibiting occurrence of a ghost image include metal-free phthalocyanine, titanyl phthalocyanine, and chloroindium phthalocyanine, among which titanyl phthalocyanine is more preferable. Titanyl phthalocyanine is represented by chemical formula (CGM-1).

(CGM-1)

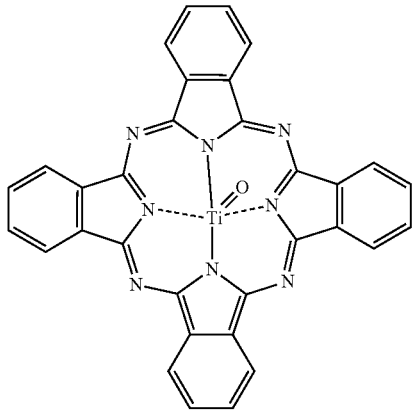

Titanyl phthalocyanine may have a crystal structure. Examples of titanyl phthalocyanine having a crystal structure include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively). Y-form titanyl phthalocyanine is preferable as the titanyl phthalocyanine.

Y-form titanyl phthalocyanine for example exhibits a main peak at a Bragg angle (2θ±0.2°) of 27.2° in a CuKα characteristic X-ray diffraction spectrum. The main peak in the CuKα characteristic X-ray diffraction spectrum refers to a peak having a highest or second highest intensity in a range of Bragg angles (2θ±0.2°) from 30 to 40°.

The following describes an example of a method for measuring the CuKα characteristic X-ray diffraction spectrum. A sample (titanyl phthalocyanine) is loaded into a sample holder of an X-ray diffraction spectrometer (e.g., "RINT (registered Japanese trademark) 1100", product of Rigaku Corporation), and an X-ray diffraction spectrum is measured using a Cu X-ray tube, a tube voltage of 40 k, a tube current of mA, and CuKα characteristic X-rays having a wavelength of 1.542 Å. The measurement range (2θ) is for example from 3° to 40° (start angle: 3°, stop angle: 40°), and the scanning rate is for example 10°/minute.

Y-form titanyl phthalocyanine is for example classified into the following three types (A) to (C) based on thermal characteristics in differential scanning calorimetry (DSC) spectra.

(A) Y-form titanyl phthalocyanine that exhibits a peak in a range of from 50° C. to 270° C. in a differential scanning calorimetry spectrum thereof, other than a peak resulting from vaporization of adsorbed water.

(B) Y-form titanyl phthalocyanine that does not exhibit a peak in a range of from 50° C. to 400° C. in a differential scanning calorimetry spectrum thereof, other than a peak resulting from vaporization of adsorbed water.

(C) Y-form titanyl phthalocyanine that does not exhibit a peak in a range of from 50° C. to 270° C. and exhibits a peak in a range of higher than 270° C. and no higher than 400° C. in a differential scanning calorimetry spectrum thereof, other than a peak resulting from vaporization of adsorbed water.

Y-form titanyl phthalocyanine is preferable that does not exhibit a peak in a range of from 50° C. to 270° C. and exhibits a peak in a range of higher than 270° C. and no greater than 400° C. in a differential scanning calorimetry spectrum thereof, other than a peak resulting from vaporization of adsorbed water. Y-form titanyl phthalocyanine exhibiting such a peak is preferably that exhibiting a single peak in a range of higher than 270° C. and no greater than 400° C., and more preferably that exhibiting a single peak at 296° C.

The following describes an example of a differential scanning calorimetry spectrum measuring method. A sample (titanyl phthalocyanine) is loaded on a sample pan, and a differential scanning calorimetry spectrum is measured using a differential scanning calorimeter (e.g., "TAS-200 DSC8230D", product of Rigaku Corporation). The measurement range is for example from 40° C. to 400° C. The heating rate is for example 20° C./minute.

The charge generating material has a content ratio to mass of the photosensitive layer 502 of preferably greater than 0.0% by mass and no greater than 1.0% by mass, and more preferably greater than 0.0% by mass and no greater than 0.5% by mass. As a result of the content ratio of the charge generating material to the mass of the photosensitive layer 502 being no greater than 1.0% by mass, an increased chargeability ratio can be attained. The mass of the photosensitive layer 502 is total mass of the materials contained in the photosensitive layer 502. Where the photosensitive layer 502 contains a charge generating material, a hole transport material, an electron transport material, and a binder resin, the mass of the photosensitive layer 502 is a total of mass of the charge generating material, mass of the hole transport material, mass of the electron transport material, and mass of the binder resin. Where the photosensitive layer 502 contains a charge generating material, a hole transport material, an electron transport material, a binder resin, and an additive, the mass of the photosensitive layer 502 is a total of mass of the charge generating material, mass of the hole transport material, mass of the electron transport material, mass of the binder resin, and mass of the additive.

(Hole Transport Material)

No particular limitations are placed on the hole transport material. Examples of the hole transport material includes nitrogen-containing cyclic compounds and condensed polycyclic compounds. Examples of the nitrogen-containing cyclic compounds and condensed polycyclic compounds include triphenylamine derivatives; diamine derivatives (specific examples include N,N,N',N'-tetraphenylbenzidine derivatives, N,N,N',N'-tetraphenylphenylenediamine derivatives, N,N,N',N'-tetraphenylnaphtylenediamine derivatives, di(aminophenylethenyl)benzene derivatives, and N,N,N',N'-tetraphenylphenanthrylenediamine derivatives); oxadiazole-based compounds (specific examples include 2,5-di(4-methylaminophenyl)-1,3,4-oxadiazole); styryl-based compounds (specific examples include 9-(4-diethylaminostyryl)anthracene); carbazole-based compounds (specific examples include polyvinyl carbazole); organic polysilane compounds; pyrazoline-based compounds (specific examples include 1-phenyl-3-(p-dimethylaminophenyl)pyrazoline); hydrazone-based compounds; indole-based compounds; oxazole-based compounds; isoxazole-based compounds; thiazole-based compounds; thiadiazole-based compounds; imidazole-based compounds; pyrazole-based compounds; and triazole-based compounds. The photosensitive layer 502 may contain only one hole transport material or may contain two or more hole transport materials.

Examples of hole transport materials that are preferable in terms of inhibiting occurrence of a ghost image include a compound represented by general formula (10) (also referred to below as a hole transport material (10)).

(10)

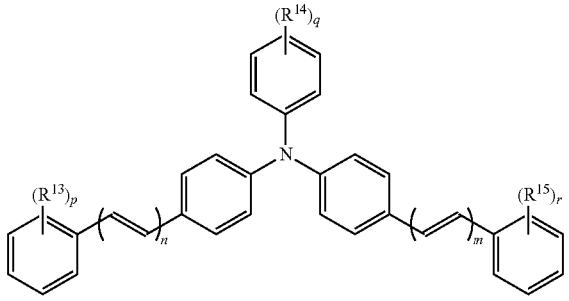

In general formula (10), $R^{13}$ to $R^{15}$ each represent, independently of each other, an alkyl group having a carbon number of at least 1 and no greater than 4 or an alkoxy group having a carbon number of at least 1 and no greater than 4. m and n each represent, independently of each other, an integer of at least 1 and no greater than 3. p and r each represent, independently of each other, 0 or 1. q represents an integer of at least 0 and no greater than 2. Where q represents 2, two chemical groups $R^{14}$ may be the same as or different from each other.

$R^{14}$ in general formula (10) is preferably an alkyl group having a carbon number of at least 1 and no greater than 4, more preferably a methyl group, an ethyl group, or an n-butyl group, and particularly preferably an n-butyl group. q Preferably represents 1 or 2, and more preferably represents 1. Each of p and r preferably represents 0. Each of m and n preferably represents 1 or 2, and more preferably represents 2.

A preferable example of the hole transport material (10) is a compound represented by chemical formula (HTM-1) (also referred to below as a hole transport material (HTM-1)).

(HTM-1)

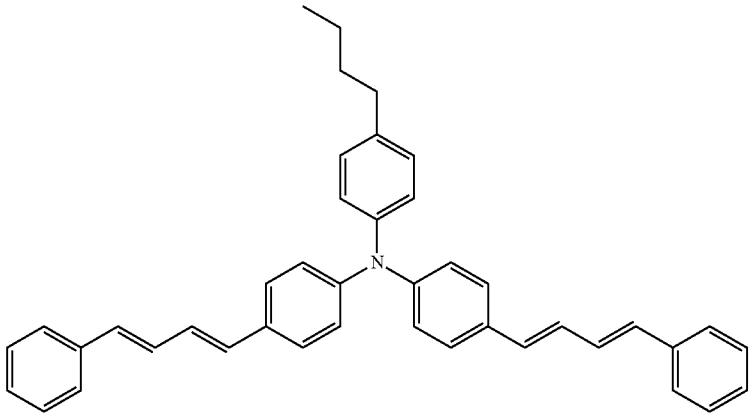

The hole transport material has a content ratio to the mass of the photosensitive layer 502 of preferably greater than 0.0% by mass and no greater than 35.0% by mass, and more preferably at least 10.0% by mass and no greater than 30.0% by mass.

(Binder Resin)

Examples of the binder resin include thermoplastic resins, thermosetting resin, and photocurable resins. Examples of the thermoplastic resins include polycarbonate resins, polyarylate resins, styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of the thermosetting resins include silicone resins, epoxy resins, phenolic resins, urea resins, and melamine resins. Examples of the photocurable resins include acrylic acid adducts of epoxy compounds and acrylic acid adducts of urethane compounds. The photosensitive layer 502 may contain only one binder resin or may contain two or more binder resins.

In order to inhibit occurrence of a ghost image, preferably, the binder resin includes a polyarylate resin including a repeating unit represented by general formula (20) (also referred to below as a polyarylate resin (20)).

(20)

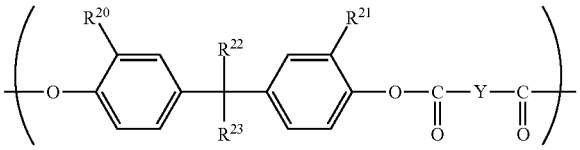

In general formula (20), $R^{20}$ and $R^{21}$ each represent, independently of each other, a hydrogen atom or an alkyl group having a carbon number of at least 1 and no greater than 4. $R^{22}$ and $R^{23}$ each represent, independently of each other, a hydrogen atom, a phenyl group, or an alkyl group having a carbon number of at least 1 and no greater than 4. $R^{22}$ and $R^{23}$ may be bonded to each other to form a divalent group represented by general formula (W). Y represents a divalent group represented by chemical formula (Y1), (Y2), (Y3), (Y4), (Y5), or (Y6).

(W)

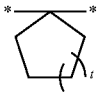

In general formula (W), t represents an integer of at least 1 and no greater than 3. The asterisks each represent a bond. Specifically, each of the asterisks in general formula (W) represents a bond to a carbon atom to which Y in general formula (20) is bonded.

(Y1)

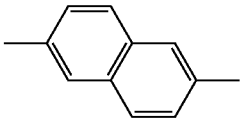

(Y2)

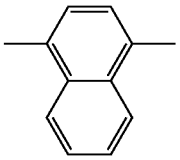

(Y3)

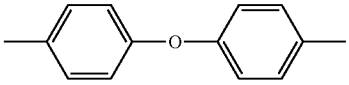

(Y4)

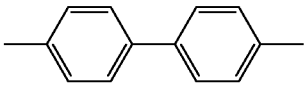

(Y5)

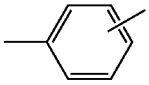

(Y6)

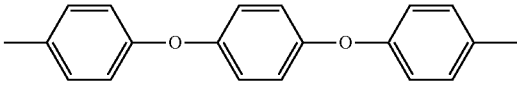

In general formula (20), each of $R^{20}$ and $R^{21}$ is preferably an alkyl group having a carbon number of at least 1 and no greater than 4, and more preferably a methyl group. $R^{22}$ and $R^{23}$ are preferably bonded to each other to form a divalent group represented by general formula (W). Y is preferably a divalent group represented by chemical formula (Y1) or (Y3). Preferably, t in general formula (W) is 2.

Preferably, the polyarylate resin (20) only includes a repeating unit represented by general formula (20). However, the polyarylate resin (20) may further include another repeating unit. A ratio (mole fraction) of the number of the repeating units represented by general formula (20) to a total number of repeating units in the polyarylate resin (20) is preferably at least 0.80, more preferably at least 0.90, and further preferably 1.00. The polyarylate resin (20) may include only one type of the repeating unit represented by general formula (20) or include two or more types (e.g., two types) of the repeating unit represented by general formula (20).

Note that in the present description, the ratio (mole fraction) of the number of repeating units represented by general formula (20) to the total number of repeating units in the polyarylate resin (20) is not a value obtained from one resin chain but a number average obtained from the entirety (a plurality of resin chains) of the polyarylate resin (20) contained in the photosensitive layer 502. The mole fraction can for example be calculated from a $^{1}$H-NMR spectrum of the polyarylate resin (20) measured using a proton nuclear magnetic resonance spectrometer.

Examples of preferable repeating units represented by general formula (20) include repeating units represented by chemical formula (20-a) and chemical formula (20-b) (also referred to below as repeating units (20-a) and (20-b), respectively). The polyarylate resin (20) preferably includes at least one of the repeating units (20-a) and (20-b), and more preferably includes both the repeating units (20-a) and (20-b).

(20-a)

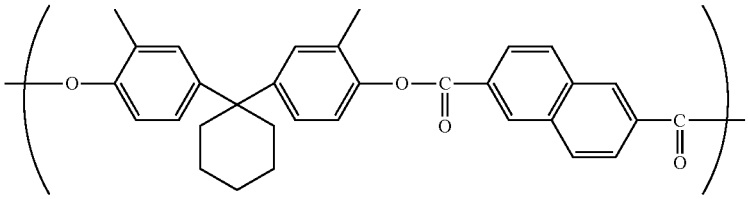

(20-b)

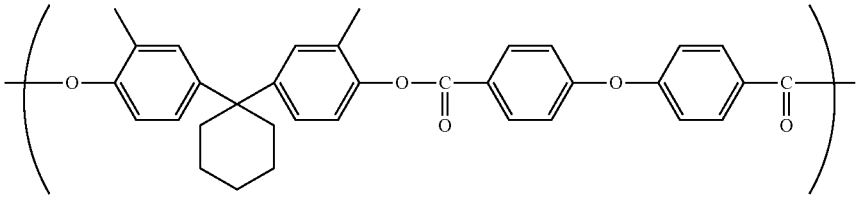

In a case of the polyarylate resin (20) including both the repeating units (20-a) and (20-b), no particular limitations are placed on the sequence of the repeating units (20-a) and (20-b). The polyarylate resin (20) including the repeating units (20-a) and (20-b) may be any of a random copolymer, a block copolymer, a periodic copolymer, and an alternating copolymer.

Examples of preferable polyarylate resins (20) including both the repeating units (20-a) and (20-b) include a polyarylate resin having a main chain represented by general formula (20-1).

(20-1)

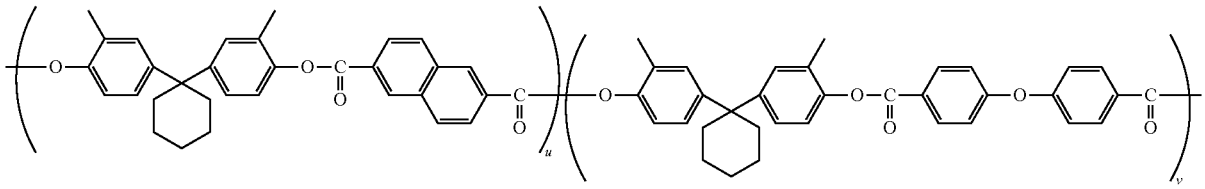

In general formula (20-1), a sum of u and v is 100. u is a number greater than or equal to 30 and less than or equal to 70.

u is preferably a number of at least 40 and no greater than 60, further preferably a number of at least 45 and no greater than 55, yet further preferably a number of at least 49 and no greater than 51, and particularly preferably a number of 50. Note that u represents a percentage of the number of the repeating units (20-a) relative to a sum of the number of the repeating units (20-a) and the number of the repeating units (20-b) in the polyarylate resin (20). v represents a percentage of the number of the repeating units (20-b) relative to the sum of the number of the repeating units (20-a) and the number of the repeating units (20-b) in the polyarylate resin (20). Examples of preferable polyarylate resins having a main chain represented by general formula (20-1) include a polyarylate resin having a main chain represented by general formula (20-1a).

(20-1a)

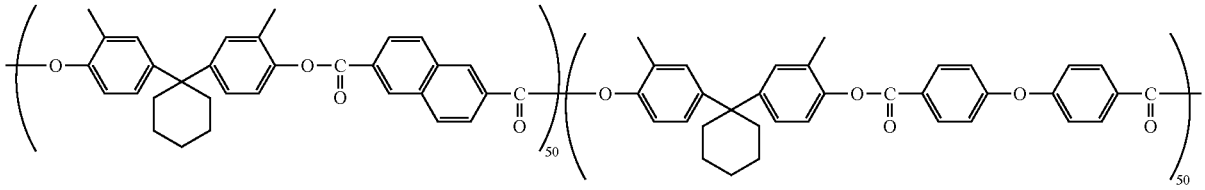

The polyarylate resin (20) may have a terminal group represented by chemical formula (Z). In chemical formula (Z), the asterisk represents a bond. Specifically, the asterisk in chemical formula (Z) represents a bond to a main chain of the polyarylate resin. In a case of the polyarylate resin (20) including the repeating unit (20-a), the repeating unit (20-b), and the terminal group represented by chemical formula (Z), the terminal group may be bonded to the repeating unit (20-a) or may be bonded to the repeating unit (20-b).

(Z)

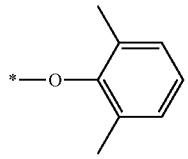

In order to inhibit occurrence of a ghost image, preferably, the polyarylate resin (20) includes a polyarylate resin having a main chain represented by general formula (20-1) and a terminal group represented by chemical formula (Z). More preferably, the polyarylate resin (20) includes a polyarylate resin having a main chain represented by general formula (20-1a) and a terminal group represented by chemical formula (Z). The polyarylate resin having a main chain represented by general formula (20-1a) and a terminal group represented by chemical formula (Z) is also referred to below as a polyarylate resin (R-1).

The binder resin has a viscosity average molecular weight of preferably at least 10,000, more preferably at least 20,000, still more preferably at least 30,000, further preferably at least 50,000, and particularly preferably at least 55,000. As a result of the viscosity average molecular weight of the binder resin being at least 10,000, the photosensitive member 50 tends to have improved abrasion resistance. The viscosity average molecular weight of the binder resin is preferably no greater than 80,000 by contrast, and more preferably no greater than 70,000. As a result of the viscosity average molecular weight of the binder resin being no greater than 80,000, the binder resin tends to readily dissolve in a solvent for photosensitive layer formation, facilitating formation of the photosensitive layer 502.

The binder resin has a content ratio to the mass of the photosensitive layer 502 of preferably at least 30.0% by mass and no greater than 70.0% by mass, and more preferably at least 40.0% by mass and no greater than 60.0% by mass.

(Electron Transport Material)

Examples of the electron transport materials include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of the quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. The photosensitive layer 502 may contain only one electron transport material or may contain two or more electron transport materials.

Examples of electron transport materials that are preferable in terms of inhibiting occurrence of a ghost image include compounds represented by general formula (31), general formula (32), and general formula (33) (also referred to below as electron transport materials (31), (32), and (33), respectively).

(31)

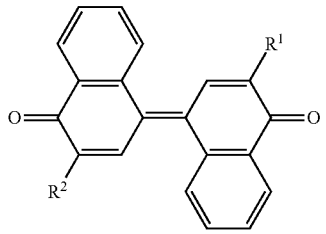

(32)

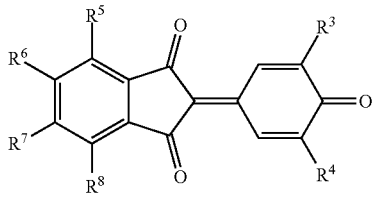

(33)

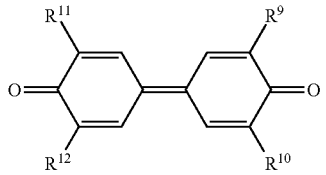

In general formulas (31) to (33), $R^1$ to $R^4$ and $R^9$ to $R^{12}$ each represent, independently of one another, an alkyl group having a carbon number of at least 1 and no greater than 8. $R^5$ to $R^8$ each represent, independently of one another, a hydrogen atom, a halogen atom, or an alkyl group having a carbon number of at least 1 and no greater than 4.

In general formulas (31) to (33), the alkyl group having a carbon number of at least 1 and no greater than 8 that may be represented by any of $R^1$ to $R^4$ and $R^9$ to $R^{12}$ is preferably an alkyl group having a carbon number of at least 1 and no greater than 5, and further preferably a methyl group, a tert-butyl group, or a 1,1-dimethylpropyl group. Preferably, $R^5$ to $R^8$ each represent a hydrogen atom.

Preferably, the electron transport material (31) is a compound represented by chemical formula (ETM-1) (also referred to below as an electron transport material (ETM-1)). Preferably, the electron transport material (32) is a compound represented by chemical formula (ETM-3) (also referred to below as an electron transport material (ETM-3)). Preferably, the electron transport material (33) is a compound represented by chemical formula (ETM-2) (also referred to below as an electron transport material (ETM-2)).

(ETM-1)

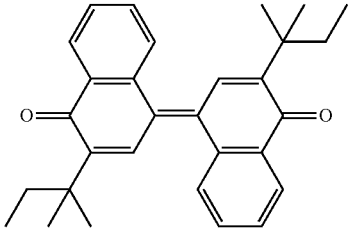

(ETM-2)

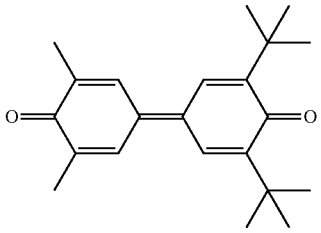

(ETM-3)

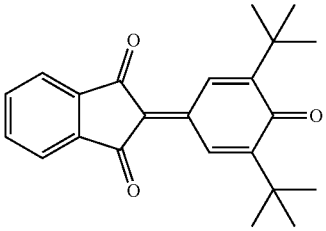

In order to inhibit occurrence of a ghost image, the photosensitive layer 502 preferably contains at least one of the electron transport materials (31) and (32) as the electron transport material, and more preferably contains both (two of) the electron transport material (31) and the electron transport material (32).

In order to inhibit occurrence of a ghost image, the photosensitive layer 502 preferably contains at least one of the electron transport materials (ETM-1) and (ETM-3) as the electron transport material, and more preferably contains both (two of) the electron transport material (ETM-1) and the electron transport material (ETM-3).

The electron transport material has a content ratio to the mass of the photosensitive layer 502 of preferably at least 5.0% by mass and no greater than 50.0% by mass, and more preferably at least 20.0% by mass and no greater than 30.0% by mass. Where the photosensitive layer 502 contains two or more electron transport materials, the content ratio of the electron transport material is a total content ratio of the two or more electron transport materials.

(Additive)

The photosensitive layer 502 may further contain a compound represented by general formula (40) (also referred to below as an additive (40)) according to necessity. However, in order to increase the chargeability ratio, preferably, the photosensitive layer 502 contains no additive (40). Where the additive is used as necessary, the content ratio of the additive (40) is set to be greater than 0.0% by mass and no greater than 1.0% by mass to the mass of the photosensitive layer 502, for example. The additive (40) can for example be used to adjust the chargeability ratio.

$$R^{40}\text{-}A\text{-}R^{41} \quad (40)$$

In general formula (40), $R^{40}$ and $R^{41}$ each represent, independently of each other, a hydrogen atom or a monovalent group represented by general formula (40a) shown below.

(40a)

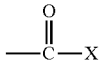

In general formula (40a), X represents a halogen atom. Examples of the halogen atom represented by X include a fluorine atom, a chlorine atom, a bromine atom, and an iodine atom. A chlorine atom is preferable as the halogen atom represented by X.

In general formula (40), A represents a divalent group represented by chemical formula (A1), (A2), (A3), (A4), (A5), or (A6) shown below. Preferably, the divalent group represented by A is the divalent group represented by chemical formula (A4).

(A1)

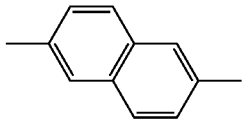

(A2)

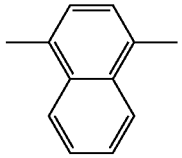

(A3)

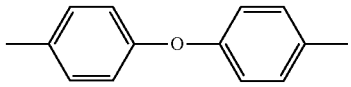

(A4)

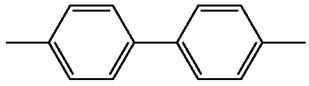

(A5)

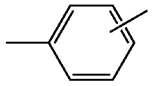

(A6)

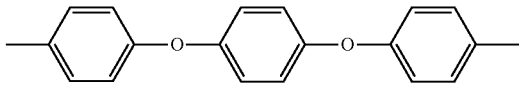

A specific example of the additive (40) is a compound represented by chemical formula (40-1) (also referred to below as an additive (40-1)).

(40-1)

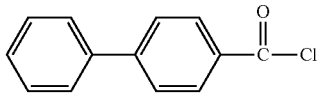

The photosensitive layer 502 may further contain an additive other than the additive (40) (also referred to below as an additional additive) according to necessity. Examples of the additional additive include antidegradants (specific examples include an antioxidant, a radical scavenger, a quencher, and an ultraviolet absorbing agent), softeners, surface modifiers, extenders, thickeners, dispersion stabilizers, waxes, donors, surfactants, and leveling agents. Where an additional additive is contained in the photosensitive layer 502, the photosensitive layer 502 may contain only one additional additive or may contain two or more additional additives.

(Material Combinations)

In order to inhibit occurrence of a ghost image, the photosensitive layer 502 preferably contains materials of types and at content ratios shown in combination example Nos. 1 to 3 in Table 1, materials of types and at content ratios shown in combination example Nos. 4 to 6 in Table 2, or materials of types and at content ratios shown in combination example Nos. 7 to 9 in Table 3.

TABLE 1

| Combination | CGM | ETM | Additive | |
|---|---|---|---|---|
| example | Content ratio | Type | Type | Content ratio |
| No. 1 | 0.5 wt % < CGM ≤ 1.0 wt % | ETM-1/ETM-3 | 40-1 | 0.0 wt % < Additive ≤ 1.0 wt % |
| No. 2 | 0.5 wt % < CGM ≤ 1.0 wt % | ETM-1/ETM-3 | — | — |
| No .3 | 0.0 wt % < CGM ≤ 0.5 wt % | ETM-1/ETM-3 | — | — |

TABLE 2

| Combination | CGM | HIM | EIM | Additive | |
|---|---|---|---|---|---|
| example | Content ratio | Type | Type | Type | Content ratio |
| No. 4 | 0.5 wt % < CGM ≤ 1.0 wt % | HTM-1 | ETM-1/ETM-3 | 40-1 | 0.0 wt % < Additive ≤ 1.0 wt % |
| No. 5 | 0.5 wt % < CGM ≤ 1.0 wt % | HTM-1 | ETM-1/ETM-3 | — | — |
| No. 6 | 0.0 wt % < CGM ≤ 0.5 wt % | HTM-1 | ETM-1/ETM-3 | — | — |

TABLE 3

| Combination | CGM | | HTM | ETM | Resin | Additive | |
|---|---|---|---|---|---|---|---|
| example | Type | Content ratio | type | Type | Type | Type | Content ratio |
| No. 7 | CGM-1 | 0.5 wt % < CGM ≤ 1.0 wt % | HTM-1 | ETM-1/ETM-3 | R-1 | 40-1 | 0.0 wt % < Additive ≤ 1.0 wt % |
| No. 8 | CGM-1 | 0.5 wt % < CGM ≤ 1.0 wt % | HTM-1 | ETM-1/ETM-3 | R-1 | — | — |
| No. 9 | CGM-1 | 0.0 wt % < CGM ≤ 0.5 wt % | HTM-1 | ETM-1/ETM-3 | R-1 | — | — |

In Tables 1 to 3, "wt %", "CGM", "HTM", "ETM", and "Resin" respectively refer to "% by mass", "charge generating material", "hole transport material", "electron transport material", and "binder resin". In Tables 1 to 3, "Content ratio" refers to each content ratio of a corresponding material to the mass of the photosensitive layer 502. In Table 1 to 3, "ETM-1/ETM-3" means each of the electron transport material (ETM-1) and the electron transport material (ETM-3) being contained as the electron transport material. In Table 1 to 3, "-" refers to no corresponding materials being contained. In Table 3, "CGM-1" refers to Y-form titanyl phthalocyanine represented by chemical formula (CGM-1). Y-form titanyl phthalocyanine shown in Table 3 is preferably Y-form titanyl phthalocyanine that does not exhibit a peak in a range of from 50° C. to 270° C. and exhibits a peak in a range of higher than 270° C. and no greater than 400° C. (specifically one peak at 296° C.) in a differential scanning calorimetry spectrum thereof, other than a peak resulting from vaporization of adsorbed water.

(Intermediate Layer)

The intermediate layer 503 contains inorganic particles and a resin used in the intermediate layer 503 (intermediate layer resin), for example. Provision of the intermediate layer 503 can facilitate flow of current generated when the photosensitive member 50 is exposed to light and inhibit increasing resistance while also maintaining insulation to a sufficient degree so as to inhibit occurrence of leakage current.

Examples of the inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one type of the inorganic particles listed above may be used independently, or any two or more types of the inorganic particles listed above may be used in combination. Note that the inorganic particles may be surface-treated. No particular limitations are placed on the intermediate layer resin other than being a resin that can be used for forming the intermediate layer 503.

(Photosensitive Member Production Method)

In an example of production methods of the photosensitive member 50, an application liquid for forming the photosensitive layer 502 (also referred to below as an application liquid for photosensitive layer formation) is applied onto the conductive substrate 501 and dried. Through the above, the photosensitive layer 502 is formed, thereby producing the photosensitive member 50. The application liquid for photosensitive layer formation is produced by dissolving or dispersing in a solvent a charge generating material, a hole transport material, an electron transport material, a binder resin, and an optional component added as necessary.

No particular limitations are placed on the solvent contained in the application liquid for photosensitive layer formation so long as each component contained in the application liquid can be dissolved or dispersed therein. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. In order to improve workability in production of the photosensitive member 50, a non-halogenated solvent (a solvent other than a halogenated hydrocarbon) is preferably used.

The application liquid for photosensitive layer formation is prepared by dispersing the components in the solvent by mixing. Mixing or dispersion can for example be performed using a bead mill, a roll mill, a ball mill, an attritor, a paint shaker, or an ultrasonic disperser.

The application liquid for photosensitive layer formation may for example contain a surfactant in order to improve dispersibility of the components.

No particular limitations are placed on the method by which the application liquid for photosensitive layer formation is applied other than being a method that enables uniform application of the application liquid for photosensitive layer formation on the conductive substrate 501. Examples of application methods that can be used include blade coating, dip coating, spray coating, spin coating, and bar coating.

No particular limitations are placed on the method by which the application liquid for photosensitive layer formation is dried other than being a method that enables evaporation of the solvent in the application liquid for photosensitive layer formation. An example of the method involves heat treatment (hot-air drying) using a high-temperature dryer or a reduced pressure dryer. The heat treatment temperature is for example from 40° C. to 150° C. The heat treatment time is for example from 3 minutes to 120 minutes.

Note that the production method of the photosensitive member 50 may further include either or both a process of forming the intermediate layer 503 and a process of forming the protective layer 504 as necessary. The process of forming the intermediate layer 503 and the process of forming the protective layer 504 are each performed according to a method appropriately selected from known methods.

Through the above, the photosensitive member 50 has been described. Referring again to FIG. 2, the following describes the toners T, the charging rollers 51, the primary transfer rollers 53, the static elimination lamps 54, and the cleaners 55 included in the image forming apparatus 1.

<Toner>

The following describes the toners T that are loaded in the cartridge 60M, the cartridge 60C, the cartridge 60Y, and the cartridge 60BK illustrated in FIG. 1 and that are to be supplied to the circumferential surfaces of the photosensitive members 50. Each toner T includes toner particles. The toner T is a collection (a powder) of the toner particles. The toner particles each include a toner mother particle and an external additive. The toner mother particle includes at least one of a binder resin, a releasing agent, a colorant, a charge control agent, and a magnetic powder. The external additive is attached to the surface of the toner mother particle. The toner particles do not need to contain any external additive if unnecessary. In a situation in which the toner particles do not contain any external additive, the toner mother particles are equivalent to the toner particles. The toner T may be a capsule toner or a non-capsule toner. The capsule toner T can be produced by forming a shell layer on the surface of each toner mother particle.

The toner T preferably has a number average roundness of at least 0.960 and no greater than 0.998. As a result of the toner T having a number average roundness of at least 0.960, development and transfer can be favorably performed, so that a truer image can be output. As a result of the number average roundness of the toner T being no greater than 0.998, the toner T is prevented from easily passing through the gap between the cleaning blade 81 and the circumferential surface 50*a* of the photosensitive member 50. The toner T preferably has a number average roundness of at least 0.960 and no greater than 0.980, more preferably at least 0.965 and no greater than 0.980, further preferably at least 0.970 and no greater than 0.980, and particularly preferably at least 0.975 and no greater than 0.980. The number average roundness of the toner T can be measured according to a method described in association with Examples.

The toner T preferably has a volume median diameter (also referred to below as $D_{50}$) of at least 4.0 m and no greater than 7.0 μm. As a result of the $D_{50}$ of the toner T being no greater than 7.0 μm, non-grainy high-definition output images can be obtained. The amount of the toner T necessary to obtain a desired image density decreases with a decrease in $D_{50}$ of the toner T. It is therefore possible to reduce the amount of the toner T to be used as long as the $D_{50}$ of the toner T is no greater than 7.0 m. As a result of the $D_{50}$ of the toner T being at least 4.0 μm, the toner T does not easily pass through the gap between the cleaning blade 81 and the circumferential surface 50*a* of the photosensitive member 50. The $D_{50}$ of the toner T is preferably at least 4.0 μm and no greater than 6.0 μm, and more preferably at least 4.0 μm and no greater than 5.0 μm. The $D_{50}$ of the toner T can be measured according to a method described in association with Examples. Note that the Do of the toner T is a value of particle diameter at 50% of cumulative distribution of a volume distribution of the toner T measured using a particle size distribution analyzer.

According to the first embodiment, occurrence of a ghost image can be inhibited even if the toner T having a small particle diameter and a high roundness as above is employed and the cleaning blades 81 are tightly pressed against the photosensitive members 50.

<Charging Roller>

Each charging roller 51 is located to be in contact with or close to the circumferential surface 50*a* of the corresponding photosensitive member 50. The image forming apparatus 1 adopts a direct discharge process or a proximity discharge process. The charging time is shorter and the amount of charge to the photosensitive member 50 is smaller in a configuration including the charging roller 51 located to be in contact with or close to the circumferential surface 50*a* of the photosensitive member 50 than in a configuration including a scorotron charger. In image formation using the image forming apparatus 1 including the charging roller 51 located to be in contact with or close to the circumferential surface 50*a* of the photosensitive member 50, therefore, it is difficult to uniformly charge the circumferential surface 50*a* of the photosensitive member 50 and a ghost image can easily occur. However, as already described, the image forming apparatus 1 according to the first embodiment can inhibit occurrence of a ghost image. Therefore, it is possible to sufficiently inhibit occurrence of a ghost image even in a configuration in which the charging roller 51 is located to be in contact with or close to the circumferential surface 50*a* of the photosensitive member 50.

The distance between the charging roller 51 and the circumferential surface 50*a* of the photosensitive member 50 is preferably no greater than 50 μm, and more preferably no greater than 30 μm. Even in a configuration in which the distance between the charging roller 51 and the circumferential surface 50*a* of the photosensitive member 50 is in such a range, the image forming apparatus 1 according to the first embodiment can satisfactorily inhibit occurrence of a ghost image.

The charging voltage (charging bias) applied to the charging roller 51 is a direct current voltage. Where the charging voltage is a direct current voltage, an amount of discharge from the charging roller 51 to the photosensitive member 50 is smaller than that in a case of the charging voltage being a composite voltage. Thus, an abrasion amount of the photosensitive layer 502 of the photosensitive member 50 can be reduced.

A ghost image tends to occur particularly when the charging roller 51 is located in contact with or close to the circumferential surface 50*a* of the photosensitive member 50 and the charging voltage is a direct current voltage. However, as a result of the photosensitive member 50 satisfying formula (1), the image forming apparatus 1 according to the first embodiment can inhibit occurrence of a ghost image even in a configuration in which the charging roller 51 is located in contact with or close to the circumferential surface 50*a* of the photosensitive member 50 and the charging voltage is a direct current voltage.

The charging roller 51 has a resistance of preferably at least 5.0 log Ω and no greater than 7.0 log Ω, and more preferably at least 5.0 log Ω and no greater than 6.0 log Ω. As a result of the charging roller 51 having a resistance of at least 5.0 log Ω, leakage hardly occurs in the photosensitive layer 502 of the photosensitive member 50. As a result of the charging roller 51 having a resistance of no greater than 7.0 log Ω, the resistance of the charging roller 51 hardly increases. The resistance of the charging roller 51 can be measured according to a method described in association with Examples.

<Transfer Belt>

The transfer belt has a surface resistivity ρS of at least 6 Log Ω and no greater than 11 Log Ω. Note that 6 Log Ω is equivalent to $1.0\times10^{6}\Omega$ and 11 Log Ω is equivalent to $1.0\times10^{11}\Omega$. Also, Ω, which is a unit of the surface resistivity ρS, is also called a/square. As a result of the transfer belt 33 having a surface resistivity ρS of at least 6 Log Ω, occurrence of a ghost image can be inhibited. As a result of the transfer belt 33 having a surface resistivity ρS of no greater than 11 Log Ω, occurrence of charge-up of the toner T on the transfer belt 33 can be inhibited. The lower the surface resistivity ρS of the transfer belt 33 is (e.g., no greater than 11 Log Ω), the more likely a ghost image tends to occur. However, the photosensitive member 50 of the image forming apparatus 1 according to the first embodiment satisfies formula (1). This can inhibit occurrence of a ghost image and charge-up of the toner T even if the transfer belt 33 has a surface resistivity ρS of no greater than 11 Log Ω.

In order to inhibit occurrence of a ghost image, the transfer belt 33 has a surface resistivity ρS of preferably at least 7 Log Ω, more preferably at least 8 Log Ω, further preferably at least 9 Log Ω, and yet further preferably at least 10 Log Ω. In order to inhibit occurrence of charge-up of the toner T, the transfer belt 33 has a surface resistivity ρS of preferably no greater than 10 Log Ω, more preferably no greater than 9 Log Ω, further preferably no greater than 8 Log Ω, and yet further preferably no greater than 7 Log Ω. In order to inhibit occurrence of a ghost image while inhibiting occurrence of charge-up of the toner T, preferably, the transfer belt 33 has a surface resistivity ρS of at least 8 Log Ω and no greater than 11 Log Ω. In order to inhibit occurrence of a ghost image while inhibiting occurrence of charge-up of the toner T, the transfer belt 33 may have a surface resistivity ρS in a range between two values selected from 6 Log Ω, 7 Log Ω, 8 Log Ω, 9 Log Ω, 10 Log Ω, and 11 Log Ω. The surface resistivity ρS of the transfer belt 33 can be measured according to a method described in association with Examples.

<Primary Transfer Roller>

Each of the primary transfer rollers 53 primarily transfers the toner image from the circumferential surface 50*a* of the corresponding photosensitive member 50 to the transfer belt 33 in a state in which static elimination is not performed on the circumferential surface 50*a* of the photosensitive member 50. The static elimination lamps 54 perform static elimination after transfer but do not perform static elimination before transfer. The image forming apparatus 1 adopts what is called a pre-transfer erasure-less process. Typically, static elimination is performed on the circumferential surface 50*a* of the photosensitive member 50 preferably before primary transfer by the primary transfer roller 53 in order to inhibit occurrence of a ghost image. This is because transfer current uniformly flows into the photosensitive member 50. However, the photosensitive member 50 satisfies formula (1) in the first embodiment. This can enable sufficient inhibition of occurrence of a ghost image even in a configuration in which static elimination is not performed on the circumferential surface 50*a* of the photosensitive member 50 before primary transfer by the primary transfer roller 53. Furthermore, when static elimination is performed before transfer, a tendency to cause toner scattering on an output image is observed which is due to production of an artifact of an electrostatic latent image formed on the circumferential surface 50*a* of the photosensitive member 50. In the first embodiment, toner scattering on an output image can be inhibited because static elimination is not performed before transfer.

Figure 9:
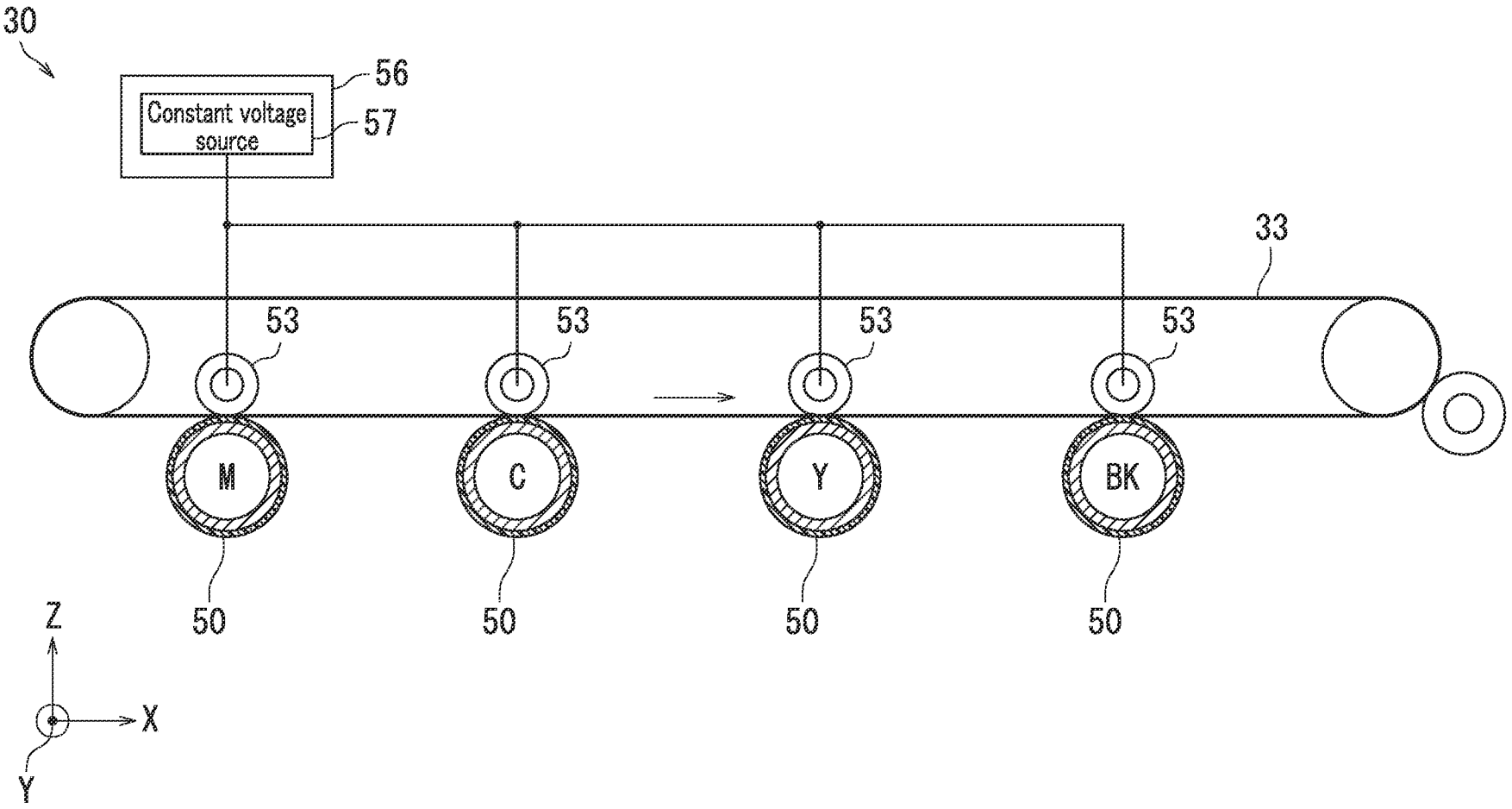
FIG. 9 is a diagram illustrating a power supply system for primary transfer rollers included in the image forming apparatus illustrated in FIG. 1.

The following describes the primary transfer rollers 53, which are under constant-voltage control, with reference to FIG. 9. FIG. 9 is a diagram illustrating a power supply system for the four primary transfer rollers 53. As illustrated in FIG. 9, the image forming section 30 further includes a power source 56 connected to the four primary transfer rollers 53. The power source 56 is capable of charging each of the primary transfer rollers 53. The power source 56 includes a constant voltage source 57 connected to the four primary transfer rollers 53. The constant voltage source 57 applies a transfer voltage (transfer bias) to the primary transfer rollers 53 to charge the primary transfer rollers 53 in primary transfer. The constant voltage source 57 generates a constant transfer voltage (e.g., a constant negative transfer voltage). That is, the primary transfer rollers 53 are under constant-voltage control. A potential difference (transfer fields) between the surface potential of the circumferential surfaces 50*a* of the photosensitive members 50 and the surface potential of the primary transfer rollers 53 causes primary transfer of the toner images carried on the circumferential surfaces 50*a* of the respective photosensitive members 50 to the outer surface of the circulating transfer belt 33.

In primary transfer, current (e.g., negative current) flows from the primary transfer rollers 53 into the respective photosensitive members 50 through the transfer belt 33. In a configuration in which the primary transfer rollers 53 are disposed directly above the respective photosensitive members 50, the current flows from the primary transfer rollers 53 into the photosensitive members 50 in a thickness direction of the transfer belt 33. The current flowing into the photosensitive members 50 (flow-in current) changes as the surface resistivity ρS and the volume resistivity of the transfer belt 33 change provided that a constant transfer voltage is applied to the primary transfer rollers 53. The tendency of a ghost image to occur increases with an increase in the flow-in current. That is, a ghost image is more likely to occur in an image formed by the image forming apparatus 1 including the primary transfer rollers 53, which are under constant-voltage control, than in an image formed by an image forming apparatus that adopts constant-current control. However, the image forming apparatus 1 according to the first embodiment includes the photosensitive members 50 capable of inhibiting occurrence of a ghost image. It is therefore possible to inhibit occurrence of a ghost image even if an image is formed using the image forming apparatus 1 including the primary transfer rollers 53 under constant-voltage control. Furthermore, in the image forming apparatus 1 including the primary transfer rollers 53 under constant-voltage control, the number of constant voltage sources 57 can be smaller than the number of primary transfer rollers 53. Thus, the image forming apparatus 1 can be simplified and miniaturized.

In order to perform stable primary transfer of the toners T from the primary transfer rollers 53 to the transfer belt 33, current (transfer current) flowing in the primary transfer rollers 53 in transfer voltage application is preferably at least −20 μA and no greater than −10 μA.

<Static Elimination Lamp>

The static elimination lamps 54 are arranged downstream of the primary transfer rollers 53 in terms of the rotational direction R of the photosensitive members 50. The cleaners 55 are arranged downstream of the static elimination lamps 54 in terms of the rotational direction R of the photosensitive members 50. The charging rollers 51 are arranged downstream of the cleaners 55 in terms of the rotational direction R of the photosensitive members 50. As a result of each static elimination lamp 54 being arranged between the corresponding primary transfer roller 53 and the corresponding cleaner 55, it is ensured that a time from static elimination of the circumferential surface 50*a* of the photosensitive member 50 by the static elimination lamp 54 to charging of the circumferential surface 50*a* of the photosensitive member 50 by the charging roller 51 (also referred to below as a static elimination-charging time) is sufficiently long. Thus, a time for eliminating excited carriers generated inside the photosensitive layer 502 can be ensured. The static elimination-charging time is preferably 20 milliseconds or longer, and more preferably 50 milliseconds or longer.

The static elimination light intensity of each static elimination lamp 54 is preferably at least 0 μJ/cm$^2$ and no greater than 10 μJ/cm$^2$, and more preferably at least 0 μJ/cm$^2$ and no greater than 5 μJ/cm$^2$. As a result of the static elimination light intensity of the static elimination lamp 54 being no greater than 10 μJ/cm$^2$, the amount of charge trapped inside the photosensitive layer 502 of the photosensitive member 50 decreases to enable chargeability of the photosensitive member 50 to increase. A smaller static elimination light intensity of the static elimination lamp 54 is more preferable. Note that the static elimination light intensity of the static elimination lamps 54 being 0 μJ/cm$^2$ means a static elimination-less system, which is a system without static elimination of the photosensitive members 50 by the static elimination lamps 54. The static elimination light intensity of the static elimination lamp 54 can be measured according to a method described in association with Examples.

<Cleaner>

The cleaners 55 each include a cleaning blade 81 and a toner seal 82. The cleaning blade 81 is located downstream of the primary transfer roller 53 in term of the rotational direction R of the photosensitive member 50. The cleaning blade 81 is pressed against the circumferential surface 50*a* of the photosensitive member 50 and collects residual toner T on the circumferential surface 50*a* of the photosensitive member 50. The residual toner T refers to toner of the toner T remaining on the circumferential surface 50*a* of the photosensitive member 50 as a result of primary transfer. Specifically, a distal end of the cleaning blade 81 is pressed against the circumferential surface 50*a* of the photosensitive member 50, and a direction from a proximal end to the distal end of the cleaning blade 81 is opposite to the rotational direction R at a point of contact between the distal end of the cleaning blade 81 and the circumferential surface 50*a* of the photosensitive member 50. The cleaning blade 81 is in what is called counter-contact with the circumferential surface 50*a* of the photosensitive member 50. Thus, the cleaning blade 81 is tightly pressed against the circumferential surface 50*a* of the photosensitive member 50 such that the cleaning blade 81 digs into the photosensitive member 50 as the photosensitive member 50 rotates. Insufficient cleaning can be further prevented through the cleaning blade 81 being tightly pressed against the circumferential surface 50*a* of the photosensitive member 50. The cleaning blade 81 is for example a plate-shaped elastic member. More specifically, the cleaning blade 81 is made from rubber with a plate shape. The cleaning blade 81 is in line-contact with the circumferential surface 50*a* of the photosensitive member 50.

The linear pressure of the cleaning blade 81 on the circumferential surface 50*a* of the photosensitive member 50 is at least 10 N/m and no greater than 40 N/m. As a result of the linear pressure of the cleaning blade 81 on the circumferential surface 50*a* of the photosensitive member 50 being at least 10 N/m, insufficient cleaning can be prevented. As a result of the linear pressure of the cleaning blade 81 on the circumferential surface 50*a* of the photosensitive member 50 being no greater than 40 N/m, occurrence of a ghost image can be inhibited. In order to particularly prevent insufficient cleaning while inhibiting occurrence of a ghost image, the linear pressure of the cleaning blade 81 on the circumferential surface 50*a* of the photosensitive member 50 is preferably at least 15 N/m and no greater than 40 N/m, more preferably at least 20 N/m and no greater than 40 N/m, still more preferably at least 25 N/m and no greater than 40 N/m, further preferably at least 30 N/m and no greater than 40 N/m, and particularly preferably at least 35 N/m and no greater than 40 N/m. The linear pressure of the cleaning blade 81 on the circumferential surface 50*a* of the photosensitive member 50 may be in a range between two values selected from 10 N/m, 15 N/m, 20 N/m, 25 N/m, 30 N/m, 35 N/m, and 40 N/m.

The cleaning blade 81 preferably has a hardness of at least 60 and no greater than 80, and more preferably at least 70 and no greater than 78. As a result of the hardness of the cleaning blade 81 being at least 60, the cleaning blade 81 is not too soft, favorably preventing insufficient cleaning. As a result of the hardness of the cleaning blade 81 being no greater than 80, the cleaning blade 81 is not too hard, reducing the abrasion amount of the photosensitive layer 502 of the photosensitive member 50. The hardness of the cleaning blade 81 can be measured according to a method described in association with Examples.

The cleaning blade 81 preferably has a rebound resilience of at least 20% and no greater than 40%, and more preferably at least 25% and no greater than 35%. The rebound resilience of the cleaning blade 81 can be measured according to a method described in association with Examples.

The toner seal 82 is located in contact with the circumferential surface 50*a* of the photosensitive member 50 between the corresponding primary transfer roller 53 and the cleaning blade 81, and prevents the toner T collected by the cleaning blade 81 from scattering.

<Thrust Mechanism>

Figure 10:
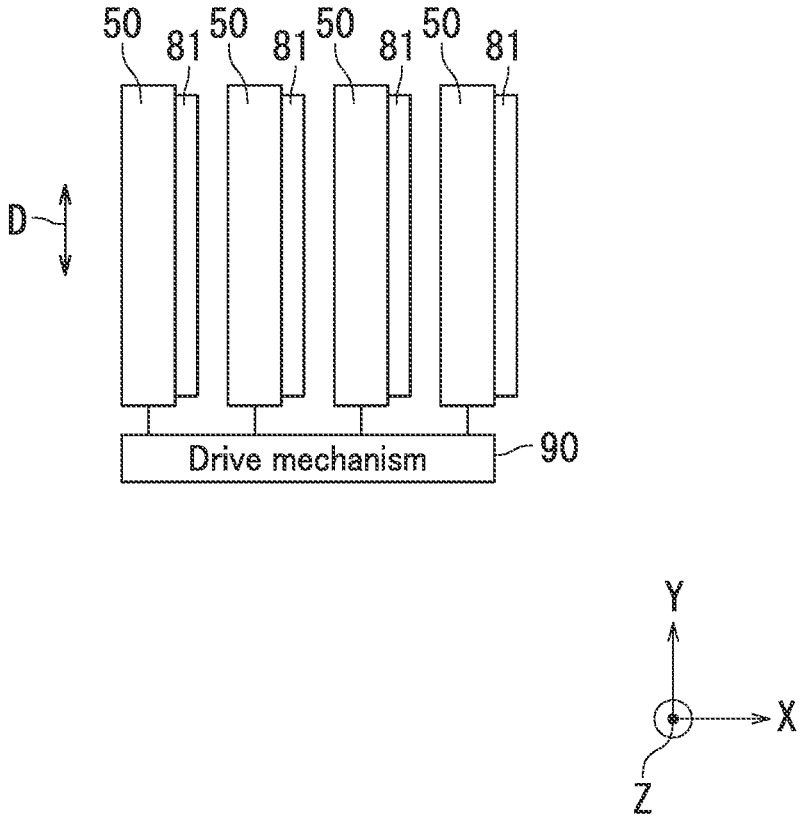
FIG. 10 is a diagram illustrating a drive mechanism for implementing a thrust mechanism.

The following describes a drive mechanism 90 for implementing a thrust mechanism with reference to FIG. 10. FIG. 10 is a plan view explaining the photosensitive members 50, the cleaning blades 81, and the drive mechanism 90. Each of the photosensitive members 50 has a circular tubular shape elongated in a rotational axis direction D of the photosensitive member 50. Each of the cleaning blades 81 has a plate-like shape elongated in the rotational axis direction D.

The image forming apparatus 1 further includes the drive mechanism 90. The drive mechanism 90 causes either the photosensitive members 50 or the cleaning blades 81 to reciprocate in the rotational axis direction D. In the first embodiment, the drive mechanism 90 causes the photosensitive members 50 to reciprocate in the rotational axis direction D. The drive mechanism 90 for example includes a drive source such as a motor, a gear train, a plurality of cams, and a plurality of elastic members. The cleaning blades 81 are secured to a housing of the image forming apparatus 1.

As described with reference to FIG. 10, the photosensitive members 50 are moved reciprocally in the rotational axis direction D relative to the cleaning blades 81 according to the first embodiment. Accordingly, local accumulation on and around the edge of each cleaning blade 81 can be moved in the rotational axis direction D, preventing a scratch in a circumferential direction (referred to below as "a circumferential scratch") from being made on the circumferential surface 50*a* of the corresponding photosensitive member 50. As a result, streaks that may occur in output images due to the toner T stuck in such a circumferential scratch are prevented from being made. Thus, good quality of resulting output images can be maintained over a long period of time.

Furthermore, according to the first embodiment, in which the photosensitive members 50 are caused to reciprocate, it is easy to obtain driving force required for the reciprocation and restrict occurrence of toner leakage over opposite ends of each of the cleaning blades 81 as compared to a configuration in which the cleaning blades 81 are caused to reciprocate.

The thrust amount of each photosensitive member 50 refers to a distance by which the photosensitive member 50 travels in one way of one back-and-forth motion. Note that in the first embodiment, an outward thrust amount and a return thrust amount are the same. The thrust amount of the photosensitive members 50 is preferably at least 0.1 mm and no greater than 2.0 mm, and more preferably at least 0.5 mm and no greater than 1.0 mm. As a result of the thrust amount of each photosensitive member 50 being within the above-specified range, circumferential scratches on the photosensitive member 50 can be favorably prevented from being made.

The thrust period of each photosensitive member 50 refers to a time taken by the photosensitive member 50 to make one back-and-forth motion. In the present description, the thrust period of the photosensitive member 50 is indicated in terms of the number of rotations of the photosensitive member 50 per back-and-forth motion of the photosensitive member 50. The rotation speed of the photosensitive member 50 is constant. Accordingly, a longer thrust period of the photosensitive member 50 (i.e., a larger number of rotations of the photosensitive member 50 per back-and-forth motion of the photosensitive member 50) means that the photosensitive member 50 reciprocates more slowly. A shorter thrust period of the photosensitive member 50 (i.e., a smaller number of rotations of the photosensitive member 50 per back-and-forth motion of the photosensitive member 50) by contrast means that the photosensitive member 50 reciprocates more quickly.

The thrust period of each photosensitive member 50 is preferably at least 10 rotations and no greater than 200 rotations, and more preferably at least 50 rotations and no greater than 100 rotations. As a result of the thrust period of the photosensitive member 50 being at least 10 rotations, it is easy to clean the circumferential surface 50*a* of the photosensitive member 50. Furthermore, as a result of the thrust period of the photosensitive member 50 being at least 10 rotations, the color image forming apparatus 1 tends not to undergo unintended coloristic shift. As a result of the thrust period of the photosensitive member 50 being no greater than 200 rotations by contrast, circumferential scratches on the photosensitive member 50 can be prevented from being made.

Through the above, the image forming apparatus 1 according to the first embodiment has been described. Although a configuration has been described in which the charging rollers 51 are employed as chargers, the image forming apparatus 1 may have a configuration in which the chargers are charging brushes located to be in contact with or close to the circumferential surfaces 50*a* of the respective photosensitive members 50. Although the chargers adopting a direct discharge process or a proximity discharge process (specifically, the charging rollers 51) have been described, the present invention is also applicable to chargers adopting a discharge process other than the direct discharge process and the proximity discharge process. Although a configuration in which the charging voltage is a direct current voltage has been described, the present disclosure is also applicable to a configuration in which the charging voltage is an alternating current voltage or a composite voltage. The composite voltage refers to a voltage of an alternating current voltage superimposed on a direct current voltage. Although the development rollers 52 each using a two-component developer containing the carrier CA and the toner T have been described, the present invention is also applicable to development devices each using a one-component developer. Furthermore, although the image forming apparatus 1 has been described that adopts an intermediate transfer process using the primary transfer rollers 53, the secondary transfer roller 34, and the transfer belt 33, the present invention is also applicable to an image forming apparatus that adopts a direct transfer process.

[Image Forming Method Implemented by Image Forming Apparatus According to First Embodiment]

The following describes an image forming method that is implemented by the image forming apparatus 1 according to the first embodiment. This image forming method includes charging, exposing to light, developing, performing primary transfer, performing secondary transfer, and cleaning. In the charging, the charging rollers 51 charge the circumferential surfaces 50*a* of the photosensitive members 50 to a positive polarity. In the exposing to light, the charged circumferential surfaces 50*a* of the photosensitive members 50 are exposed to light to form electrostatic latent images on the circumferential surfaces 50*a* of the photosensitive members 50. In the developing, the electrostatic latent images are developed into toner images through supply of the toner T to the electrostatic latent images. In the performing primary transfer, the toner images are primarily transferred from the circumferential surfaces 50*a* of the photosensitive members 50 to the transfer belt 33 that is in contact with the circumferential surfaces 50*a*. In the performing secondary transfer, the toner images are secondarily transferred from the transfer belt 33 to a sheet P. In the cleaning, residual toner T remaining on the circumferential surfaces 50*a* of the photosensitive members 50 as a result of the primary transfer of the toner images is collected by pressing the cleaning blades 81 against the circumferential surfaces 50*a* of the photosensitive members 50. The transfer belt 33 has a surface resistivity ρS of at least 6 Log Ω and no greater than 11 Log Ω. The linear pressure of the cleaning blades 81 on the circumferential surfaces 50*a* of the photosensitive members 50 is at least 10 N/m and no greater than 40 N/m. The photosensitive members 50 each include the conductive substrate 501 and the photosensitive layer 502 of a single layer. The photosensitive layer 502 contains a charge generating material, a hole transport material, an electron transport material, and a binder resin. The photosensitive member 50 satisfies formula (1) described above. With the image forming method that is implemented by the image forming apparatus 1 according to the first embodiment, occurrence of a ghost image and charge-up of the toner T can be inhibited.

[Image Forming Apparatus According to Second Embodiment and Image Forming Method]

The following describes an image forming apparatus according to a second embodiment. The image forming apparatus according to the second embodiment includes an image bearing member, a charger, a light exposure device, a development device, a transfer belt, a primary transfer device, a secondary transfer device, and a cleaning member. The charger charges a circumferential surface of the image bearing member to a positive polarity. The light exposure device exposes the charged circumferential surface of the image bearing member to light to form an electrostatic latent image on the circumferential surface of the image bearing member. The development device develops the electrostatic latent image into a toner image through supply of a toner to the electrostatic latent image. The transfer belt is in contact with the circumferential surface of the image bearing member. The primary transfer device primarily transfers the toner image from the circumferential surface of the image bearing member to the transfer belt. The secondary transfer device secondarily transfers the toner image from the transfer belt to a recording medium. The cleaning member is pressed against the circumferential surface of the image bearing member and collects residual toner of the toner remaining on the circumferential surface of the image bearing member as a result of the toner image being primarily transferred. The transfer belt has a surface resistivity of at least 6 Log Ω and no greater than 11 Log Ω. A linear pressure of the cleaning member on the circumferential surface of the image bearing member is at least 10 N/m and no greater than 40 N/m. The image bearing member includes a conductive substrate and a photosensitive layer of a single layer. The photosensitive layer contains a charge generating material, a hole transport material, an electron transport material, and a binder resin. The charge generating material has a content ratio to mass of the photosensitive layer of greater than 0.0% by mass and no greater than 0.5% by mass. No particular limitations are placed on values related to formula (1) for the image bearing member in the image forming apparatus according to the second embodiment. The same description and preferred examples given with respect to the image forming apparatus according to the first embodiment apply to the image forming apparatus according to the second embodiment except values related to formula (1) for the image bearing member. With the image forming apparatus according to the second embodiment, occurrence of a ghost image and toner charge-up can be inhibited.

The following describes an image forming method that is implemented by the image forming apparatus according to the second embodiment. This image forming method includes charging, exposing to light, developing, performing primary transfer, performing secondary transfer, and performing cleaning. In the charging, a circumferential surface of an image bearing member is charged to a positive polarity. In the exposing to light, the charged circumferential surface of the image bearing member is exposed to light to form an electrostatic latent image on the circumferential surface of the image bearing member. In the developing, the electrostatic latent image is developed into a toner image through supply of a toner to the electrostatic latent image. In the performing primary transfer, the toner image is primarily transferred from the circumferential surface of the image bearing member to a transfer belt that is in contact with the circumferential surface of the image bearing member. In the performing secondary transfer, the toner image is secondarily transferred from the transfer belt to a recording medium. In the performing cleaning, cleaning is performed to collect residual toner by pressing a cleaning member against the circumferential surface of the image bearing member. The residual toner is toner of the toner remaining on the circumferential surface of the image bearing member as a result of the primary transfer of the toner. The transfer belt has a surface resistivity of at least 6 Log Ω and no greater than 11 Log Ω. A linear pressure of the cleaning member on the circumferential surface of the image bearing member is at least 10 N/m and no greater than 40 N/m. The image bearing member includes a conductive substrate and a photosensitive layer of a single layer. The photosensitive layer contains a charge generating material, a hole transport material, an electron transport material, and a binder resin. The charge generating material has a content ratio to mass of the photosensitive layer of greater than 0.0% by mass and no greater than 0.5% by mass. No particular limitations are placed on values related to formula (1) for the image bearing member in the image forming method implemented by the image forming apparatus according to the second embodiment. With the image forming method that is implemented by the image forming apparatus according to the second embodiment, occurrence of a ghost image and toner charge-up can be inhibited.

[Image Forming Apparatus According to Third Embodiment and Image Forming Method]

The following describes an image forming apparatus according to a third embodiment. The image forming apparatus according to the third embodiment includes an image bearing member, a charger, a light exposure device, a development device, a transfer belt, a primary transfer device, a secondary transfer device, and a cleaning member. The charger charges a circumferential surface of the image bearing member to a positive polarity. The light exposure device exposes the charged circumferential surface of the image bearing member to light to form an electrostatic latent image on the circumferential surface of the image bearing member. The development device develops the electrostatic latent image into a toner image through supply of a toner to the electrostatic latent image. The transfer belt is in contact with the circumferential surface of the image bearing member. The primary transfer device primarily transfers the toner image from the circumferential surface of the image bearing member to the transfer belt. The secondary transfer device secondarily transfers the toner image from the transfer belt to a recording medium. The cleaning member is pressed against the circumferential surface of the image bearing and collects residual toner of the toner remaining on the circumferential surface of the image bearing member as a result of the toner image being primarily transferred. The transfer belt has a surface resistivity of at least 6 Log Ω and no greater than 11 Log Ω. A linear pressure of the cleaning member on the circumferential surface of the image bearing member is at least 10 N/m and no greater than 40 N/m. The image bearing member includes a conductive substrate and a photosensitive layer of a single layer. The photosensitive layer contains a charge generating material, a hole transport material, an electron transport material, and a binder resin. The charge generating material has a content ratio to mass of the photosensitive layer of greater than 0.0% by mass and no greater than 1.0% by mass. The photosensitive layer contains no additive (40) or further contains an additive (40) at a content ratio to the mass of the photosensitive layer of greater than 0.0% by mass and no greater than 1.0% by mass. No particular limitations are placed on values related to formula (1) for the image bearing member in the image forming apparatus according to the third embodiment. The same description and preferred examples given with respect to the image forming apparatus according to the first embodiment apply to the image forming apparatus according to the third embodiment except values related to formula (1) for the image bearing member. With the image forming method that is implemented by the image forming apparatus according to the third embodiment, occurrence of a ghost image and toner charge-up can be inhibited.

The following describes an image forming method implemented by the image forming apparatus according to the third embodiment. This image forming method includes charging, exposing to light, developing, performing primary transfer, performing secondary transfer, and performing cleaning. In the charging, a circumferential surface of an image bearing member is charged to a positive polarity. In the exposing to light, the charged circumferential surface of the image bearing member is exposed to light to form an electrostatic latent image on the circumferential surface of the image bearing member. In the developing, the electrostatic latent image is developed into a toner image through supply of a toner to the electrostatic latent image. In the performing primary transfer, the toner image is primarily transferred from the circumferential surface of the image bearing member to a transfer belt that is in contact the circumferential surface of the image bearing member. In the performing secondary transfer, the toner image is secondarily transferred from the transfer belt to a recording medium. In the performing cleaning, cleaning is performed to collect residual toner by pressing a cleaning member against the circumferential surface of the image bearing member. The residual toner is toner of the toner remaining on the circumferential surface of the image bearing member as a result of the primary transfer of the toner image. The transfer belt has a surface resistivity of at least 6 Log Ω and no greater than 11 Log Ω. A linear pressure of the cleaning member on the circumferential surface of the image bearing member is at least 10 N/m and no greater than 40 N/m. The image bearing member includes a conductive substrate and a photosensitive layer of a single layer. The photosensitive layer contains a charge generating material, a hole transport material, an electron transport material, and a binder resin. The charge generating material has a content ratio to mass of the photosensitive layer of greater than 0.0% by mass and no greater than 1.0% by mass. The photosensitive layer contains no additive (40) or further contains an additive (40) at a content ratio to the mass of the photosensitive layer of greater than 0.0% by mass and no greater than 1.0% by mass. No particular limitations are placed on values related to formula (1) for the image bearing member in the image forming method implemented by the image forming apparatus according to the third embodiment. With the image forming method that is implemented by the image forming apparatus according to the third embodiment, occurrence of a ghost image and toner charge-up can be inhibited.

EXAMPLES

The following provides further specific description of the present invention through use of Examples. Note that the present invention is not limited to the scope of Examples.

<Measuring Method>

The following first describes methods for measuring physical properties in tests of examples and comparative examples.

($D_{50}$ of Toner)

The $D_{50}$ of a target toner was measured using a particle size distribution analyzer ("COULTER COUNTER MULTISIZER 3", product of Beckman Caulter, Inc.).

(Number Average Roundness of Toner)

The number average roundness of the target toner was measured using a flow particle imaging analyzer ("FPIA (registered Japanese trademark) 3000", product of Sysmex Corporation).

(Static Elimination Light Intensity)

An optical power meter ("OPTICAL POWER METER 3664", product of HIOKI E.E. CORPORATION) was embedded in a position of the circumferential surface of a target photosensitive member opposite to a static elimination lamp. Static elimination light having a wavelength of 660 nm was radiated onto the photosensitive member using the static elimination lamp, and the intensity of the static elimination light at the circumferential surface of the photosensitive member was measured using the optical power meter.

(Linear Pressure of Cleaning Blade)

The linear pressure of a target cleaning blade was measured using a load cell ("LMA-A SMALL-SIZED COMPRESSION LOAD CELL", product of Kyowa Electronic Instruments Co., Ltd.). Specifically, the load cell was replaced with a photosensitive member in an evaluation apparatus such that the load cell was disposed in a position of contact between the cleaning blade and the circumferential surface of the photosensitive member. The angle of contact between the cleaning blade and the load cell was set to 23 degrees. The cleaning blade was pressed against the load cell. The linear pressure of the cleaning blade was measured using the load cell ten seconds after the start of the pressing. The thus measured linear pressure was taken to be the linear pressure of the cleaning blade.

(Hardness of Cleaning Blade)

The hardness of the cleaning blade was measured using a rubber hardness tester ("ASKER RUBBER HARDNESS TESTER Type JA", product of KOBUNSHI KEIKI CO., LTD.) by a method in accordance with JIS K 6301.

(Rebound Resilience of Cleaning Blade)

The rebound resilience of the cleaning blade was measured using a rebound resilience tester ("RT-90", product of KOBUNSHI KEIKI CO., LTD) by a method in accordance with JIS K 6255 (corresponding to ISO 4662). The rebound resilience was measured under environmental conditions of a temperature of 25° C. and a relative humidity of 50%.

(Surface Resistivity ρS of Transfer Belt)

The surface resistivity ρS of a target transfer belt was measured using a resistivity meter ("HIRESTA-UX MCP-HT800", product of Mitsubishi Chemical Analytech Co., Ltd.) by a method in accordance with JIS K 6911. Measurement conditions included an application voltage of 250 V and a load of 2 kgf. The surface resistivity ρS was measured ten seconds after voltage application.

<Evaluation Apparatus>

The following describes an evaluation apparatus used for the tests of the examples and the comparative examples. The evaluation apparatus was a modified version of a multifunction peripheral ("TASKalfa 356Ci", product of KYOCERA Document Solutions Inc.). The configuration and settings of the evaluation apparatus were mostly as follows.

Photosensitive member: positively-chargeable single-layer OPC drum

Diameter of photosensitive member: 30 mm

Film thickness of photosensitive layer of photosensitive member: 30 μm

Linear velocity of photosensitive member: 250 mm/second

Thrust amount of photosensitive member: 0.8 mm

Thrust period of photosensitive member: 70 rotations/back-and-forth motion

Charger: charging roller

Charging voltage: direct current voltage of positive polarity

Material of charging roller: epichlorohydrin rubber with an ion conductor dispersed therein Diameter of charging roller: 12 mm Thickness of rubber-containing layer of charging roller: 3 mm Resistance of charging roller: 5.8 log Ω upon application of a charging voltage of +500 V Distance between charging roller and circumferential surface of photosensitive member: 0 μm (contact)

Effective charge length: 226 mm

Transfer process: intermediate transfer process

Transfer voltage: direct current voltage of negative polarity

Material of transfer belt: polyimide

Transfer width: 232 mm

Pre-transfer static elimination: not done

Post-transfer static elimination: done

Static elimination light intensity: 5 $\mu J/cm^2$

Static elimination-charging time: 125 millisecond

Cleaner: counter-contact cleaning blade

Contact angle of cleaning blade: 23 degrees

Material of cleaning blade: polyurethane rubber

Hardness of cleaning blade: 73

Rebound resilience of cleaning blade: 30%

Thickness of cleaning blade: 1.8 mm

Pressing method of cleaning blade: by fixing digging amount of cleaning blade in photosensitive member (fixed deflection)

Digging amount of cleaning blade in photosensitive member: value in range of from 0.8 mm to 1.5 mm (value varying depending on linear pressure of cleaning blade)

<Photosensitive Member Production>

Photosensitive members of the examples and the comparative examples to be mounted in an image forming apparatus were produced next. Materials for forming photosensitive layers used in the production of the photosensitive members and methods for producing the photosensitive member are as follows.

As the materials for forming the photosensitive layers of the photosensitive members, a charge generating material, a hole transport material, electron transport materials, a binder resin, and an additive described below were prepared.

(Charge Generating Material)

Y-form titanyl phthalocyanine represented by chemical formula (CGM-1) described in association with the first embodiment was prepared as the charge generating material. This Y-form titanyl phthalocyanine did not exhibit a peak in a range of from 50° C. to 270° C. and exhibited a peak in a range of higher than 270° C. and no greater than 400° C. (specifically, a single peak at 296° C.) in a differential scanning calorimetry spectrum thereof, other than a peak resulting from vaporization of adsorbed water.

(Hole Transport Material)

The hole transport material (HTM-1) described in association with the first embodiment was prepared as the hole transport material.

(Electron Transport Material)

The electron transport materials (ETM-1) and (ETM-3) described in association with the first embodiment were prepared as the hole transport material.

(Binder Resin)

The polyarylate resin (R-1) described in association with the first embodiment was prepared as the binder resin. The polyarylate resin (R-1) had a viscosity average molecular weight of 60,000.

(Additive)

The additive (40-1) described in association with the first embodiment was prepared as the additive.

(Production of Photosensitive Member (P-A1))

A vessel of a ball mill was charged with 1.0 part by mass of the Y-form titanyl phthalocyanine as the charge generating material, 20.0 parts by mass of the hole transport material (HTM-1), 12.0 parts by mass of the electron transport material (ETM-1), 12.0 parts by mass of the electron transport material (ETM-3), 55.0 parts by mass of the polyarylate resin (R-1) as the binder resin, and tetrahydrofuran as a solvent. The vessel contents were mixed for 50 hours using the ball mill to disperse the materials (the charge generating material, the hole transport material, the electron transport materials, and the binder resin) in the solvent. Thus, an application liquid for photosensitive layer formation was obtained. The application liquid for photosensitive layer formation was applied onto a conductive substrate—an aluminum drum-shaped support—by dip coating to form a liquid film. The liquid film was hot-air dried at 100° C. for 40 minutes. Through the above, a single-layer photosensitive layer (film thickness 30 μm) was formed on the conductive substrate. As a result, a photosensitive member (P-A1) was obtained.

(Production of Photosensitive Members (P-A2) and (P-B1))

Photosensitive members (P-A2) and (P-B1) each were produced according to the same method as in the production of the photosensitive member (P-A1) in all aspects other than that the charge generating material in an amount specified in Table 4 was used, the hole transport material in an amount specified in Table 4 was used, the electron transport material(s) of type and in an amount specified in Table 4 was used, and the binder resin in an amount specified in Table 4 was used.

(Production of Photosensitive Members (P-A3) and (P-B2))

Photosensitive members (P-A3) and (P-B2) each were produced according to the same method as in the production of the photosensitive member (P-A1) in all aspects other than that the additive of type and in an amount specified in Table 4 was added. Note that the additive (40-1) was added in order to adjust chargeability of the photosensitive members.

<Measurement of Chargeability Ratio>

The chargeability ratio of each of the photosensitive members (P-A1) to (P-A3), (P-B1), and (P-B2) was measured according to the chargeability ratio measuring method described in association with the first embodiment. Table 4 shows results of chargeability ratio measurement.

In Table 4, "wt %", "CGM", "HTM", "ETM", and "Resin" respectively refer to "% by mass", "charge generating material", "hole transport material", "electron transport material", and "binder resin". In Table 4, "ETM-1/ETM-3" and "12.0/12.0" refer to addition of both 12.0 parts by mass of the electron transport material (ETM-1) and 12.0 parts by mass of the electron transport material (ETM-3). In Table 4, "-" refers to no addition of a corresponding material. The amount of each material in Table 4 indicates a percentage (unit: % by mass) of the mass of the material relative to the mass of the photosensitive layer. The mass of the photosensitive layer is equivalent to the total mass of solids (more specifically, the charge generating material, the hole transport material, the electron transport material(s), the binder resin, and the additive) added to the application liquid for photosensitive layer formation.

TABLE 4

| | CGM | | HTM | | ETM | | Resin | | Additive | | |
|---|---|---|---|---|---|---|---|---|---|---|---|
| Photosensitive member | Type | Amount [wt %] | Type | Amount [wt %] | Type | Amount [wt %] | Type | Amount [wt %] | Type | Amount [wt %] | Chargeability ratio |
| P-B1 | CGM-1 | 1.7 | HTM-1 | 36.0 | ETM-1 | 23.0 | R-1 | 39.3 | — | — | 0.32 |
| P-B2 | CGM-1 | 1.0 | HTM-1 | 20.0 | ETM-1/ETM-3 | 12.0/12.0 | R-1 | 53.6 | 40-1 | 1.4 | 0.48 |
| P-A3 | CGM-1 | 1.0 | HTM-1 | 20.0 | ETM-1/ETM-3 | 12.0/12.0 | R-1 | 54.2 | 40-1 | 0.8 | 0.61 |
| P-A1 | CGM-1 | 1.0 | HTM-1 | 20.0 | ETM-1/ETM-3 | 12.0/12.0 | R-1 | 55.0 | — | — | 0.71 |
| P-A2 | CGM-1 | 0.5 | HTM-1 | 20.0 | ETM-1/ETM-3 | 12.0/12.0 | R-1 | 55.5 | — | — | 0.95 |

<Relationship Between Linear Pressure of Cleaning Blade and Number Average Roundness of Toner for $D_{50}$ of Toner>

The relationship was studied first between linear pressure of a cleaning blade necessary for cleaning and number average roundness of toners for $D_{50}$ of the toners. Specifically, the photosensitive member (P-B1) was mounted in the evaluation apparatus. A toner was loaded into a toner container of the evaluation apparatus, and a developer containing the toner and a carrier was loaded into a development device of the evaluation apparatus. The surface resistivity ρS of the transfer belt was 10.5 Log Ω. An image I (a black longitudinal band-shaped image having a length of 100 mm parallel with the rotation direction of the photosensitive member) was printed on 100,000 successive sheets of paper using the evaluation apparatus under low-temperature and low-humidity environmental conditions (temperature: 10° C., relative humidity: 10%). The 100,000-sheet printing was a condition for the surface roughness of the cleaning blade and the surface roughness of the circumferential surface of the photosensitive member to increase. The low-temperature and low-humidity environmental conditions were for the hardness of the cleaning blade to increase and for the cleaning blade to easily decrease in performance. The evaluation apparatus was set so as not to perform toner transfer, specifically, so as not to perform transfer voltage application during printing of the image I. Due to non-performance of toner transfer, all toner developed on the circumferential surface of the photosensitive member was collected by the cleaning blade. After the 100,000-sheet printing, the circumferential surface of the photosensitive member was visually observed to confirm presence or absence of toner that had escaped capture by the cleaning blade on the circumferential surface of the photosensitive member. The above-described test was repeated by gradually increasing the linear pressure of the cleaning blade to determine the lowest linear pressure at which the cleaning blade was able to completely prevent the toner from escaping its capture (a minimum linear pressure necessary for preventing insufficient cleaning).

Figure 11:
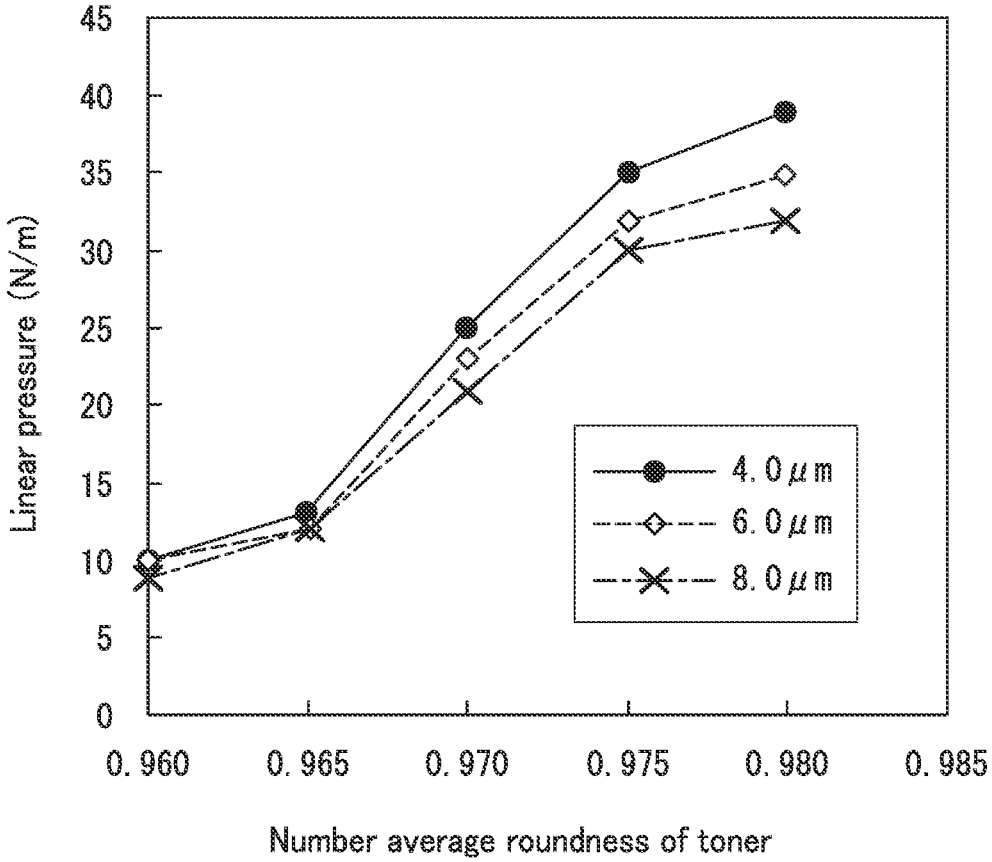
FIG. 11 is a graph representation illustrating relationships between number average roundness of toner and linear pressure of a cleaning blade for volume median diameters of toners.

The minimum linear pressure for preventing insufficient cleaning was measured with respect to each of 15 toners having a $D_{50}$ of any of 4.0 μm, 6.0 μm, and 8.0 μm and a number average roundness of any of 0.960, 0.965, 0.970, 0.975, and 0.980. FIG. 11 shows measurement results. In FIG. 11, the vertical axis indicates minimum linear pressure for preventing insufficient cleaning (unit: N/m), and the horizontal axis indicates number average roundness of the toners. In FIG. 11, circles on the plot indicate measurement results of the toners having a $D_{50}$ of 4.0 μm, diamonds on the plot indicate measurement results of the toners having a $D_{50}$ of 6.0 μm, and crosses on the plot indicate measurement results of the toners having a $D_{50}$ of 8.0 μm.

FIG. 11 demonstrates that the smaller the $D_{50}$ of toner is, the higher the minimum linear pressure necessary for preventing insufficient cleaning is. FIG. 11 also demonstrates that the higher the number average roundness of toner is, the higher the minimum linear pressure necessary for preventing insufficient cleaning is. It can be understood from FIG. 11 that a linear pressure of at least 10 N/m is necessary for the use of the toner having a $D_{50}$ of 6.0 μm and a number average roundness of 0.960. It can be also understood from FIG. 11 that it is preferable to set the linear pressure to approximately 40 N/m for the use of the toner having a $D_{50}$ of 4.0 μm and a number average roundness of 0.980. The above-described tendency of the photosensitive member (P-B1), which had a chargeability ratio of lower than 0.60, indicated in FIG. 11 is expected to be true for photosensitive members having a chargeability ratio of at least 0.60. Therefore, study was made as follows on photosensitive members that can inhibit occurrence of a ghost image even if the linear pressure of the cleaning blade is set to at least 10 N/m and no greater than 40 N/m.

<Ghost Image Evaluation>

(Ghost Image Evaluation on Photosensitive Member (P-B1))

The photosensitive member (P-B1) was mounted in the evaluation apparatus. The transfer belt of the evaluation apparatus had a surface resistivity ρS of 10.5 Log Ω. The transfer current of a primary transfer roller of the evaluation apparatus was set to −10 μA. The linear pressure of a cleaning blade of the evaluation apparatus was set to 20 N/m. A charging roller of the evaluation apparatus was used to charge the circumferential surface of the photosensitive member to a potential of +500 V. The potential (+500V) of the charged circumferential surface of the photosensitive member was taken to be a surface potential $V_A$ (Unit: +V). Next, the primary transfer roller of the evaluation apparatus was used to apply a transfer voltage to the charged circumferential surface of the photosensitive member. The potential of the circumferential surface of the photosensitive member after the transfer voltage application was measured using a surface electrometer (not illustrated, "ELECTROSTATIC VOLTMETER Model 344", product of TREK, INC.), and taken to be a surface potential $V_B$ (unit: +V). The surface potential drop $\Delta V_{B-A}$ (unit: V) due to transfer was calculated from the thus measured surface potential $V_B$ in accordance with the following equation: "$\Delta V_{B-A}$=surface potential $V_B$−surface potential $V_A$=surface potential $V_{B\text{-}500}$".

Figure 12:
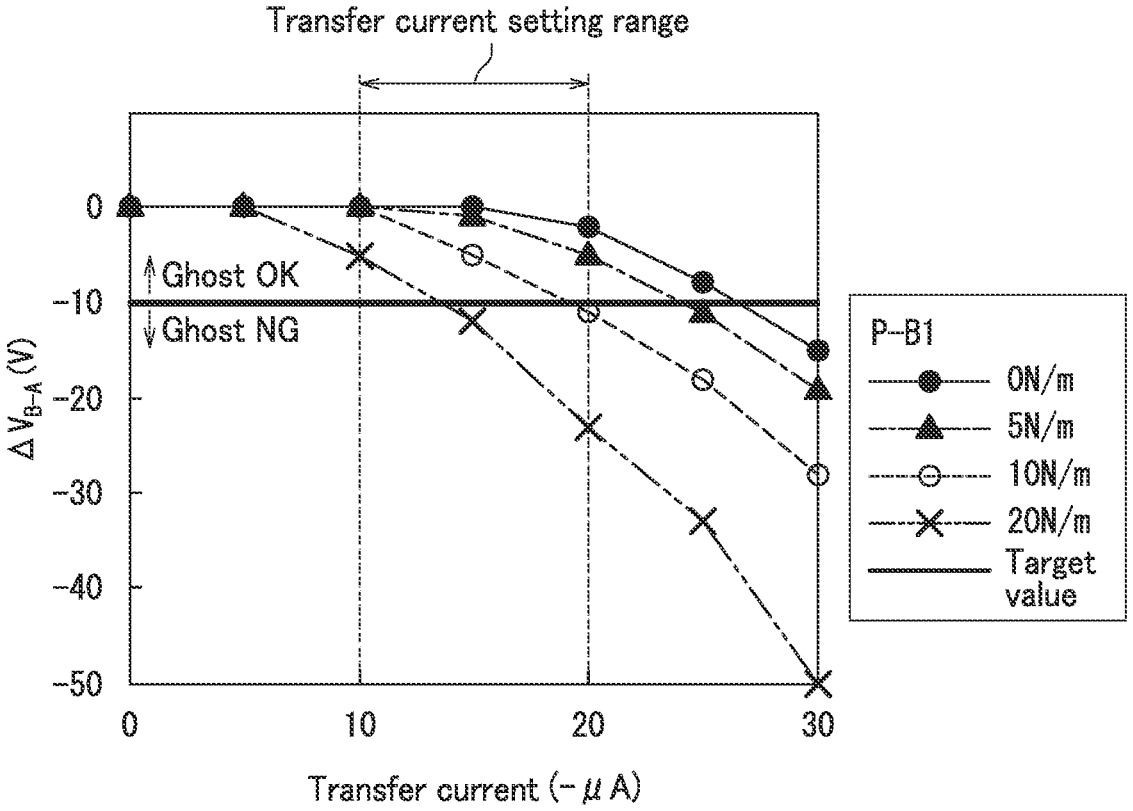
FIG. 12 is a graph representation illustrating relationships between transfer current and surface potential drop due to transfer for a photosensitive member according to a comparative example.

Next, the transfer current of the primary transfer roller of the evaluation apparatus was set to 0 μA, −5 μA, −15 μA, −20 μA, −25 μA, and −30 μA, and the surface potential drop $\Delta V_{B-A}$ (unit: V) due to transfer at each of these values of the transfer current was measured according to the same method as described above. Next, the linear pressure of the cleaning blade of the evaluation apparatus was set to 0 N/m, 5 N/m, and 10 N/m, and the surface potential drop $\Delta V_{B-A}$ (unit: V) due to transfer at each of these values of the linear pressure was measured according to the same method as described above. No transfer voltage was applied for a transfer current of 0 μA. The cleaning blade was removed from the evaluation apparatus for a linear pressure of the cleaning blade of 0 N/m. FIG. 12 shows measurement results of the surface potential drop $\Delta V_{B-A}$ due to transfer for the photosensitive members (P-B1).

(Ghost Image Evaluation on Photosensitive Member (P-A1))

Figure 13:
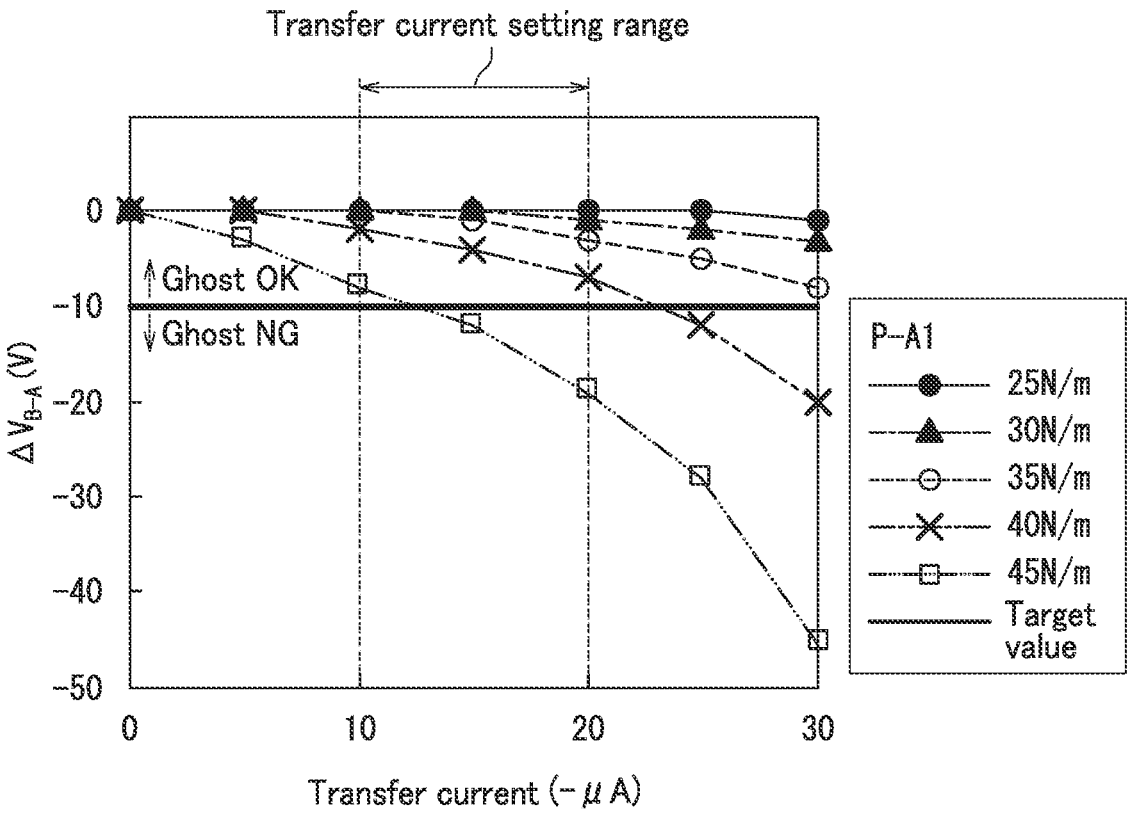
FIG. 13 is a graph representation illustrating relationships between transfer current and surface potential drop due to transfer for photosensitive members according to an example.

The photosensitive member (P-A1) was mounted in the evaluation apparatus. The surface potential drop $\Delta V_{B-A}$ (unit: V) due to transfer was measured according to the same method as in the ghost image evaluation on the photosensitive member (P-B1). The transfer current of the primary transfer roller of the evaluation apparatus was set to 0 μA, −5 μA, −10 μA, −15 μA, −20 μA, −25 μA, and −30 μA, and the surface potential drop $\Delta V_{B-A}$ (unit: V) due to transfer at each of these values of the transfer current was measured. Furthermore, the linear pressure of the cleaning blade of the evaluation apparatus was set to 25 N/m, 30 N/m, 35 N/m, 40 N/m, and 45 N/m, and the surface potential drop $\Delta V_{B-A}$ (unit: V) due to transfer at each of these values of the linear pressure was measured. FIG. 13 shows measurement results of the surface potential drop $\Delta V_{B-A}$ due to transfer for the photosensitive member (P-A1).

(Criteria for Ghost Image Evaluation)

When the absolute value of the surface potential drop $\Delta V_{B-A}$ due to transfer is 10 V or higher, a ghost image tends to occur on an output image. Further, a range of the set transfer current (transfer current setting range) is preferably at least −20 μA and no greater than −10 μA in order to perform stable primary transfer of a toner to a transfer belt. From the above consideration, the photosensitive members were evaluated as being capable of inhibiting occurrence of a ghost image (denoted by "Ghost OK") if the absolute value of the surface potential drop $\Delta V_{B-A}$ due to transfer was lower than 10 V under any of conditions of set transfer currents of −20 μA, —15 μA, and −10 μA. The photosensitive members were evaluated as being incapable of inhibiting occurrence of a ghost image (denoted by "Ghost NG") if the absolute value of the surface potential drop $\Delta V_{B-A}$ due to transfer was 10 V or higher under at least one of the conditions of set transfer current values of −20 μA, −15 μA, and −10 μA.

(Result of Ghost Image Evaluation)

As shown in FIGS. 12 and 13, the absolute value of the surface potential drop $\Delta V_{B-A}$ due to transfer increased with an increase in the linear pressure of the cleaning blade. As also shown in FIGS. 12 and 13, the absolute value of the surface potential drop $\Delta V_{B-A}$ due to transfer increased with a decrease (to be closer to −30 μA) in the set transfer current.

FIG. 12 indicates the following about the photosensitive member (P-B1) having a chargeability ratio of lower than 0.60. As indicated in FIG. 12, when the linear pressure of the cleaning blade was set to 10 N/m or 20 N/m, the absolute value of the surface potential drop $\Delta V_{B-A}$ due to transfer for the photosensitive member (P-B1) was 10 V or higher under at least one of the conditions of set transfer currents of −20 μA, −15 μA, and −10 μA. The absolute value of the surface potential drop $\Delta V_{B-A}$ due to transfer increases with an increase in the linear pressure of the cleaning blade. Accordingly, as for the photosensitive member (P-B1), the absolute value of the surface potential drop $\Delta V_{B-A}$ due to transfer is expected to be 10 V or higher under at least one of the conditions of set transfer currents of −20 μA, −15 μA, and −10 μA also when the linear pressure of the cleaning blade is set to 30 N/m or 40 N/m. It is therefore decided that the photosensitive member (P-B1) having a chargeability ratio of lower than 0.60 is incapable of inhibiting occurrence of a ghost image when the linear pressure of the cleaning blade is at least 10 N/m and no greater than 40 N/m and the transfer current of the primary transfer roller is at least −20 μA and no greater than −10 μA.

FIG. 13 indicates the following about the photosensitive member (P-A1) having a chargeability ratio of at least 0.60. As for the photosensitive member (P-A1), as shown in FIG. 13, the absolute value of the surface potential drop $\Delta V_{B-A}$ due to transfer was lower than 10 V under any of the conditions of set transfer currents of −20 μA, −15 μA, and −10 μA when the linear pressure of the cleaning blade was set to any of 25 N/m, 30 N/m, 35 N/m, and 40 N/m. The absolute value of the surface potential drop $\Delta V_{B-A}$ due to transfer decreases with a decrease in the linear pressure of the cleaning blade. Accordingly, as for the photosensitive member (P-A1), the absolute value of the surface potential drop $\Delta V_{B-A}$ due to transfer is expected to be lower than 10 V under any of the conditions of set transfer currents of −20 μA, −15 μA, and −10 μA also when the linear pressure of the cleaning blade is set to any of 10 N/m, 15 N/m, and 20 N/m. It is therefore decided that the photosensitive member (P-A1) having a chargeability ratio of at least 0.60 is capable of inhibiting occurrence of a ghost image when the linear pressure of the cleaning blade is at least 10 N/m and no greater than 40 N/m and the transfer current of the primary transfer roller is at least −20 μA and no greater than −10 μA.

<Relationship Between Chargeability Ratio of Photosensitive Member and Ghost Image Evaluation>

The photosensitive member (P-B1) was mounted in the evaluation apparatus. The surface resistivity ρS of the transfer belt of the evaluation apparatus was 10.5 Log Ω. The transfer current of the primary transfer roller of the evaluation apparatus was set to −20 μA. The linear pressure of the cleaning blade of the evaluation apparatus was set to 40 N/m. The charging roller of the evaluation apparatus was used to charge the circumferential surface of the photosensitive member to a potential of +500 V. The potential (+500 V) of the charged circumferential surface of the photosensitive member was taken to be a surface potential $V_A$ (Unit: +V). Next, the primary transfer roller of the evaluation apparatus was used to apply a transfer voltage to the charged circumferential surface of the photosensitive member. The potential of the circumferential surface of the photosensitive member after the transfer voltage application was measured using a surface electrometer (not illustrated, "SURFACE ELECTROMETER MODEL 344", product of TREK, INC.), and the measured value was taken to be a surface potential $V_B$ (Unit: +V). The surface potential drop $\Delta V_{B-A}$ (unit: V) due to transfer was calculated from the thus measured surface potential $V_B$ in accordance with an equation "$\Delta V_{B-A}$=surface potential $V_B$−surface potential $V_A$=surface potential $V_B$−500". The photosensitive member (P-B1) was changed to the photosensitive members (P-A1), (P-A2), (P-A3), and (P-B2), and the surface potential drop $\Delta V_{B-A}$ due to transfer for each of the photosensitive members was measured according to the same method as described above.

Figure 14:
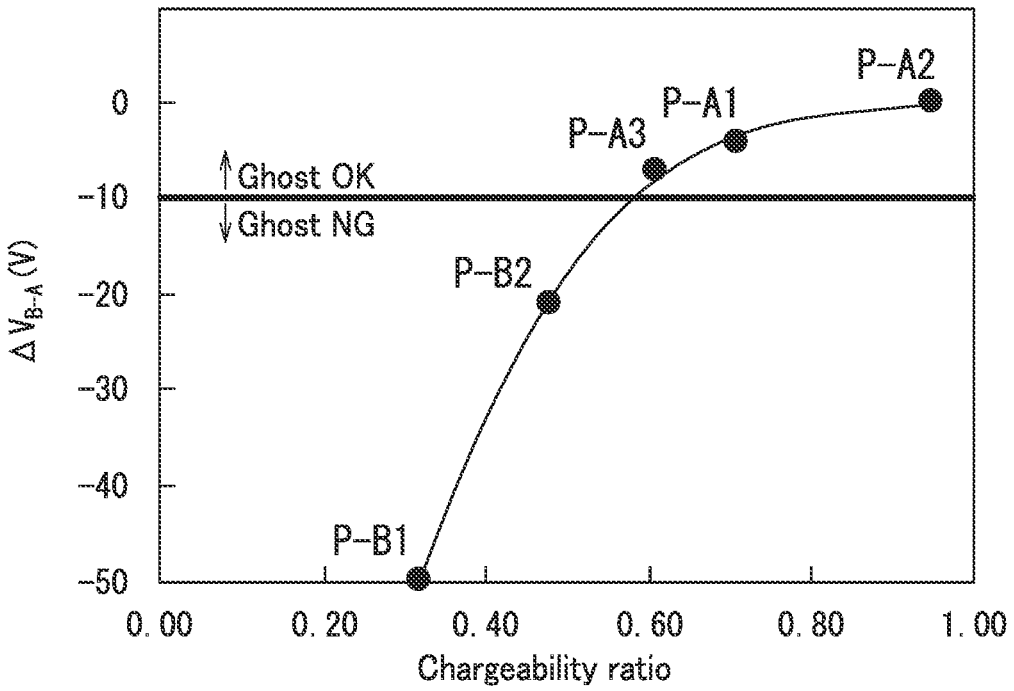
FIG. 14 is a graph representation illustrating a relationship between chargeability ratio and surface potential drop due to transfer for photosensitive members.

FIG. 14 shows measurement results of the surface potential drop $\Delta V_{B-A}$ due to transfer for the photosensitive members. The photosensitive members were evaluated as being capable of inhibiting occurrence of a ghost image (denoted by "Ghost OK") if the absolute value of the surface potential drop $\Delta V_{B-A}$ due to transfer was lower than 10 V in FIG. 14. The photosensitive members were evaluated as being incapable of inhibiting occurrence of a ghost image (denoted by "Ghost NG") if the absolute value of the surface potential drop $\Delta V_{B-A}$ due to transfer was 10V or higher in FIG. 14.

The photosensitive members (P-B1) and (P-B2), which had a chargeability ratio of less than 0.60, each had an absolute value of the surface potential drop $\Delta V_{B-A}$ due to transfer of 10 V or higher as shown in FIG. 14. It is therefore decided that the photosensitive members (P-B1) and (P-B2) were incapable of inhibiting occurrence of a ghost image when used to form images. By contrast, the photosensitive members (P-A1) to (P-A3), which had a chargeability ratio of at least 0.60, each had an absolute value of the surface potential drop $\Delta V_{B-A}$ due to transfer of lower than 10 V as shown in FIG. 14. It is therefore decided that the photosensitive members (P-A1) to (P-A3) were capable of inhibiting occurrence of a ghost image when used to form images.

<Relationship between Surface Resistivity ρS of Transfer Belt and Ghost Image Evaluation or Toner Charge-Up Evaluation>

The photosensitive member (P-A1) was mounted in the evaluation apparatus. The transfer current of the primary transfer roller of the evaluation apparatus was set to −10 μA. The linear pressure of the cleaning blade of the evaluation apparatus was set to 20 N/m. A toner (number average roundness: 0.968, D50: 6.8 μm) was loaded into the toner container of the evaluation apparatus, and a developer containing the toner and a carrier was loaded into the development device of the evaluation apparatus. The surface resistivity ρS of the transfer belt of the evaluation apparatus was set to 5 Log Ω, 6 Log Ω, 8 Log Ω, 10 Log Ω, 11 Log Ω, 12 Log Ω, and 13 Log Ω, and the following printing was performed for each of the values of the surface resistivity ρS. An image I was printed on one sheet of paper using the evaluation apparatus under environmental conditions of a temperature of 23° C. and a relative humidity of 50%. The image I included an image region IA on a leading edge side of the paper and an image region IB on a trailing edge side of the paper in terms of a paper conveyance direction. The image region IA included a circular solid image portion and a background blank image portion. The image region IA corresponded to an image region formed through the first rotation of the photosensitive member in formation of the image I. The image region IB included a halftone image portion. The image region IB corresponded to an image region formed through the second rotation of the photosensitive member in formation of the image I.

(Ghost Image Evaluation)

A spectrophotometer ("SPECTROEYE (registered Japanese trademark) available at SAKATA INX ENG CO., LTD.) was used to measure the reflection density (reflection density A) of an area of the halftone image portion of the image I corresponding to the solid image portion of the image I and the reflection density (reflection density B) of an area of the halftone image portion of the image I corresponding to the background blank image portion of the image I. Then, a reflection density difference ΔE was calculated in accordance with an equation "ΔE=|reflection density A−reflection density B|". According to the reflection density difference ΔE, whether or not occurrence of a ghost image was inhibited was evaluated based on the following criteria.

Good: ΔE was no greater than 3.0 and occurrence of ghost image was inhibited.

Poor: ΔE was greater than 3.0 and occurrence of ghost image was not inhibited.

(Evaluation of Toner Charge-Up)

Directly after the printing of the image I, a compact toner draw-off charge measurement system ("MODEL 212HS", product of TREK, INC.) was used to suck toner on the transfer belt after the toner had passed through the primary transfer roller of the BK unit (after fourth primary transfer) and before the toner had passed through the secondary transfer roller. The charge amount (unit: μC/g) of the sucked toner was then measured using the compact toner draw-off charge measurement system. Whether or not occurrence of toner charge-up was inhibited was evaluated from the measured charge amount based on the following criteria.

Good: charge amount was no greater than 70 μC/g and occurrence of toner charge-up was inhibited.

Poor: charge amount was greater than 70 ρC/g and occurrence of toner charge-up was not inhibited.

Figure 15:
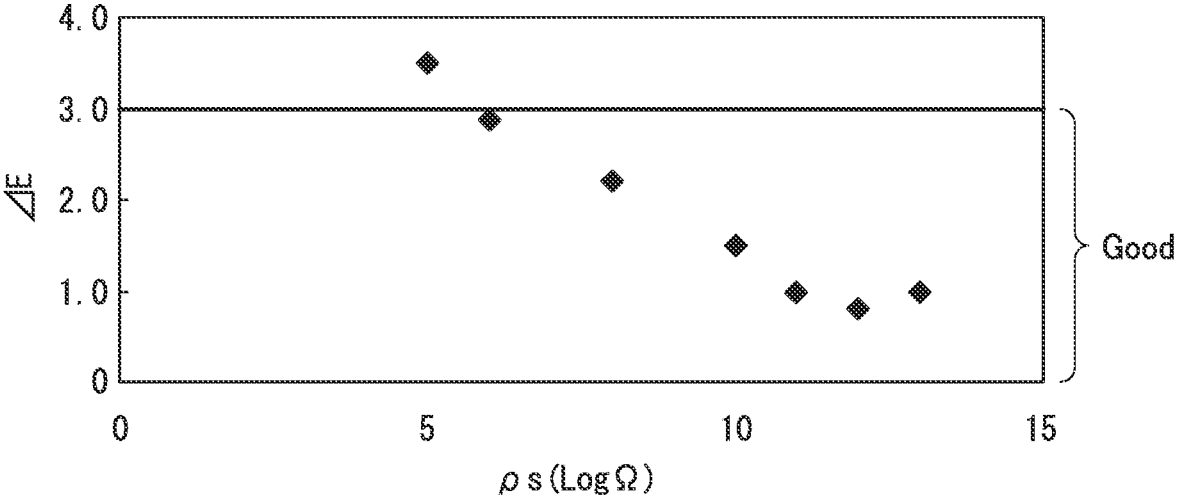
FIG. 15 is a graph representation illustrating a relationship between surface resistivity of a transfer belt and reflection density difference in output images.
Figure 16:
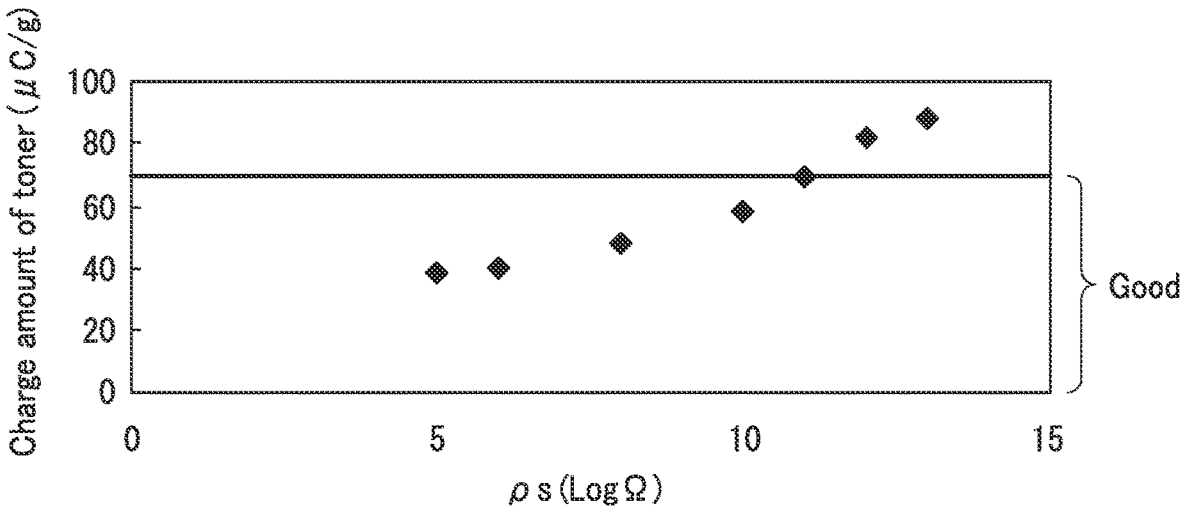
FIG. 16 is a graph representation illustrating a relationship between surface resistivity of the transfer belt and charge amount of toner on the transfer belt.

Table 5 shows measurement results of reflection density differences ΔE and charge amounts when transfer belts having the respective surface resistivities ρS were used. Also, FIG. 15 shows measurement results of reflection density differences ΔE when the transfer belts having the respective surface resistivities ρS were used. FIG. 16 also shows measurement results of charge amounts when the transfer belts having the respective surface resistivities ρS were used.

TABLE 5

| Photosensitive member | ρS [LogΩ] | Ghost image ΔE | Toner charge-up Charge amount [μC/g] |
|---|---|---|---|
| P-A1 | 5 | 3.5 | 38 |
| | 6 | 2.9 | 40 |
| | 8 | 2.2 | 48 |
| | 10 | 1.5 | 58 |
| | 11 | 1.0 | 69 |
| | 12 | 0.8 | 82 |
| | 13 | 1.0 | 88 |

As shown in Table 5 and FIGS. 15 and 16, the image forming apparatus including the photosensitive member (P-A1) having a chargeability ratio of at least 0.60 achieved inhibition of occurrence of both a ghost image and toner charge-up when the transfer belt had a surface resistivity ρS of at least 6 Log Ω and no greater than 11 Log Ω.

<Other Characteristics of Photosensitive Member>

With respect to each of the photosensitive members, surface friction coefficient, Martens hardness of the photosensitive layer, and sensitivity were measured.

(Surface Friction Coefficient of Circumferential Surface of Photosensitive Member)

With respect to each of the photosensitive members, a non-woven fabric ("KIMWIPES S-200", product of NIPPON PAPER CRECIA CO., LTD.) was placed on the photosensitive member and a weight (load: 200 gf) was placed on the circumferential surface of the non-woven fabric. An area of contact between the weight and the circumferential surface of the photosensitive member with the non-woven fabric therebetween was 1 $cm^2$. The photosensitive member was caused to laterally slide at a rate of 50 mm/second while the weight was fixed. Lateral friction force in the lateral sliding was measured using a load cell ("LMA-A, small-sized compression load cell", product of Kyowa Electronic Instruments Co., Ltd.). The surface friction coefficient of the circumferential surface of the photosensitive member was calculated in accordance with the following equation "surface friction coefficient=measured lateral friction force/200". The circumferential surfaces of the photosensitive members (P-A1) to (P-A3) had surface friction coefficients of 0.45, 0.52, and 0.50, respectively. By contrast, the circumferential surfaces of the photosensitive members (P-B1) and (P-B2) had surface friction coefficients of 0.55 and 0.53, respectively.

(Martens Hardness of Photosensitive Layer)

The Martens hardness was measured using a hardness tester ("FISCHERSCOPE (registered Japanese trademark) HM2000XYp", product of Fischer Instruments K.K.) by a nanoindentation method in accordance with ISO 14577. The measurement was carried out as described below under environmental conditions of a temperature of 23° C. and a relative humidity of 50%. That is, a square pyramidal diamond indenter (opposite sides angled at 135 degrees) was brought into contact with the circumferential surface of the photosensitive layer, a load was gradually applied to the indenter at a rate of 10 mN/5 seconds, the load was retained for one second once the load reached 10 mN, and the load was removed five seconds after the retention. The thus measured Martens hardness of the photosensitive layer of the photosensitive member (P-A1) was 220 $N/mm^2$.

(Sensitivity of Photosensitive Member)

With respect to each of the photosensitive members (P-A1) to (P-A3), sensitivity was evaluated. Sensitivity was evaluated under environmental conditions of a temperature of 23° C. and a relative humidity of 50%. First, the circumferential surface of the photosensitive member was charged to +500 V using a drum sensitivity test device (product of Gen-Tech, Inc.). Next, monochromatic light (wavelength: 780 nm, half-width: 20 nm, light intensity: 1.0 $\mu J/cm^2$) was obtained from white light of a halogen lamp using a band-pass filter. The thus obtained monochromatic light was radiated onto the circumferential surface of the photosensitive member. A surface potential of the circumferential surface of the photosensitive member was measured when 50 milliseconds elapsed from termination of the radiation. The thus measured surface potential was taken to be a post-exposure potential (unit: +V). The photosensitive members (P-A1), (P-A2), and (P-A3) resulted in a post-exposure potential of +110 V a post-exposure potential of +108 V, and a post-exposure potential of +98 V respectively.

These results demonstrated that the photosensitive members (P-A1) to (P-A3) each have a surface friction coefficient of the circumferential surface, a Martens hardness of the photosensitive layer, and sensitivity that are suitable for image formation.

The above demonstrated that the image forming apparatus according to the present invention, which encompasses image forming apparatuses including any of the photosensitive members (P-A1) to (P-A3), can achieve inhibition of occurrence of both a ghost image and toner charge-up.

INDUSTRIAL APPLICABILITY

The image forming apparatus according to the present invention is applicable for image formation on recording media.

The invention claimed is:

1. An image forming apparatus comprising:

an image bearing member;

a charger configured to charge a circumferential surface of the image bearing member to a positive polarity;

a light exposure device configured to expose the charged circumferential surface of the image bearing member to light to form an electrostatic latent image on the circumferential surface of the image bearing member;

a development device configured to develop the electrostatic latent image into a toner image through supply of a toner to the electrostatic latent image;

a transfer belt that is in contact with the circumferential surface of the image bearing member;

a primary transfer device configured to primarily transfer the toner image from the circumferential surface of the image bearing member to the transfer belt;

a secondary transfer device configured to secondarily transfer the toner image from the transfer belt to a recording medium; and a cleaning member pressed against the circumferential surface of the image bearing member and configured to collect residual toner of the toner remaining on the circumferential surface of the image bearing member as a result of the toner being primarily transferred, wherein the transfer belt has a surface resistivity of at least 6 Log Ω and no greater than 11 Log Ω, a linear pressure of the cleaning member on the circumferential surface of the image bearing member is at least 10 N/m and no greater than 40 N/m, the image bearing member includes a conductive substrate and a photosensitive layer of a single layer, the photosensitive layer contains a charge generating material, a hole transport material, an electron transport material, and a binder resin, the hole transport material includes a compound represented by chemical formula (HTM-1), the electron transport material includes both a compound represented by chemical formula (ETM-1) and a compound represented by chemical formula (ETM-3), the binder resin is a polyarylate resin having a main chain represented by general formula (20-1a) and a terminal group represented by chemical formula (Z), the binder resin having a content ratio to mass of the photosensitive layer of at least 54.2% by mass and no greater than 55.5% by mass, and the image bearing member satisfies formula (1)

(HTM-1)

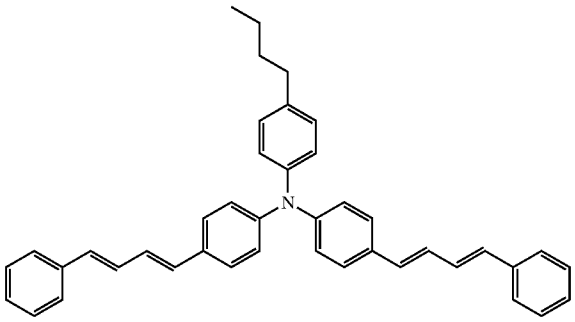

(ETM-1)

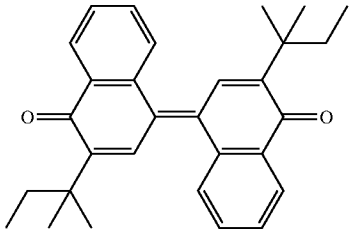

(ETM-3)

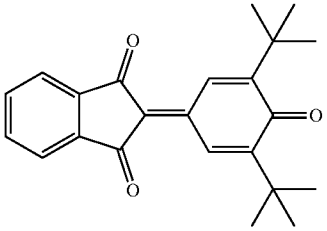

(20-1a)

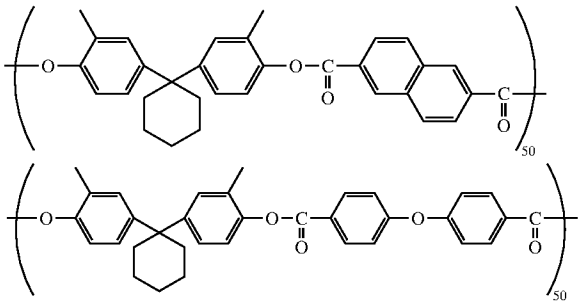

(Z)

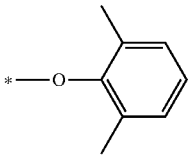

$$0.06 \leqq \frac{V}{(Q/S)\times(d/\varepsilon_r\cdot\varepsilon_0)} \quad (1)$$

where in the formula (1),

Q represents a charge amount of the image bearing member,

S represents a charge area of the image bearing member, d represents a film thickness of the photosensitive layer, $\varepsilon_r$ represents a specific permittivity of the binder resin contained in the photosensitive layer, $\varepsilon_0$ represents the vacuum permittivity, V represents a value calculated from an equation $V=V_0-V_r$, $V_r$ represents a first potential of the circumferential surface of the image bearing member yet to be charged by the charger, and $V_0$ represents a second potential of the circumferential surface of the image bearing member charged by the charger.

2. The image forming apparatus according to claim 1, wherein the photosensitive layer contains a compound represented by general formula (40), and the compound represented by the general formula (40) has a content ratio to mass of the photosensitive layer of greater than 0.0% by mass and no greater than 1.0% by mass $$R^{40}\text{-}A\text{-}R^{41} \quad (40)$$

where in the general formula (40), $R^{40}$ and $R^{41}$ each represent, independently of each other, a hydrogen atom or a monovalent group represented by general formula (40a), and A represents a divalent group represented by chemical formula (A1), (A2), (A3), (A4), (A5), or (A6)

(40a)

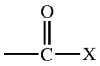

where in the general formula (40a), X represents a halogen atom (A1)

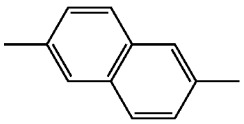

(A4)

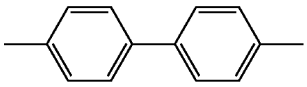

(A2)

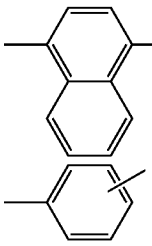

(A3)

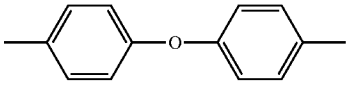

(A6)

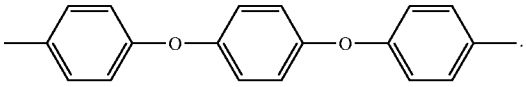

3. The image forming apparatus according to claim 2, wherein the compound represented by the general formula (40) is a compound represented by chemical formula (40-1)

(40-1)

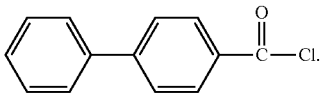

4. The image forming apparatus according to claim 1, wherein the charge generating material has a content ratio to mass of the photosensitive layer of greater than 0.0% by mass and no greater than 1.0% by mass.

5. The image forming apparatus according to claim 1, wherein the toner has a number average roundness of at least 0.960 and no greater than 0.998, and the toner has a volume median diameter of at least 4.0 μm and no greater than 7.0 μm.

6. The image forming apparatus according to claim 1, wherein the primary transfer device primarily transfers the toner image from the circumferential surface of the image bearing member to the transfer belt in a state in which static elimination is not performed on the circumferential surface of the image bearing member.

7. The image forming apparatus according to claim 1, wherein a transfer current of the primary transfer device is at least −20 μA and no greater than −10 μA.

8. The image forming apparatus according to claim 1, wherein the charger is disposed to be in contact with or close to the circumferential surface of the image bearing member.

9. An image forming method comprising:

charging a circumferential surface of an image bearing member to a positive polarity;

exposing the charged circumferential surface of the image bearing member to light to form an electrostatic latent image on the circumferential surface of the image bearing member;

developing the electrostatic latent image into a toner image through supply of a toner to the electrostatic latent image;

performing primary transfer of the toner image from the circumferential surface of the image bearing member to a transfer belt that is in contact with the circumferential surface;

performing secondary transfer of the toner image from the transfer belt to a recording medium; and performing cleaning to collect residual toner by pressing a cleaning member against the circumferential surface of the image bearing member, the residual toner being toner of the toner remaining on the circumferential surface of the image bearing member as a result of the primary transfer of the toner image being, wherein the transfer belt has a surface resistivity of at least 6 Log Ω and no greater than 11 Log Ω, a linear pressure of the cleaning member on the circumferential surface of the image bearing member is at least 10 N/m and no greater than 40 N/m, the image bearing member includes a conductive substrate and a photosensitive layer of a single layer, the photosensitive layer contains a charge generating material, a hole transport material, an electron transport material, and a binder resin, the hole transport material includes a compound represented by chemical formula (HTM-1), the electron transport material includes both a compound represented by chemical formula (ETM-1) and a compound represented by chemical formula (ETM-3), the binder resin is a polyarylate resin having a main chain represented by general formula (20-1a) and a terminal group represented by chemical formula (Z), the binder resin having a content ratio to mass of the photosensitive layer of at least 54.2% by mass and no greater than 55.5% by mass, and the image bearing member satisfies formula (1):

(HTM-1)

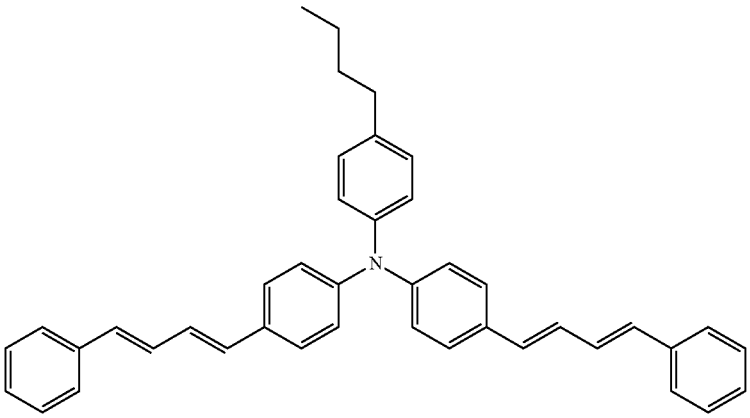

-continued (ETM-1)

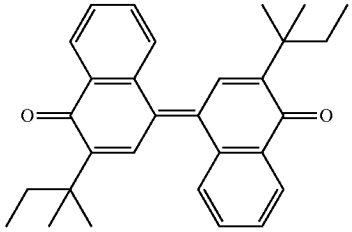

(ETM-3)

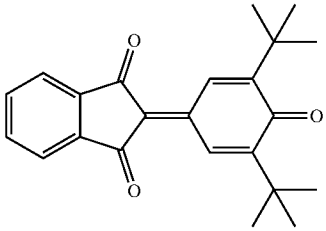

(20-1a)

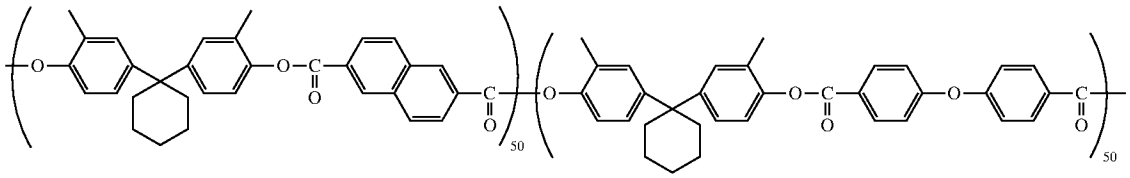

(Z)

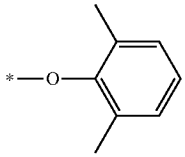

$$0.06 \leqq \frac{V}{(Q/S)\times(d/\varepsilon_r\cdot\varepsilon_0)} \quad (1)$$

where in the formula (1),

Q represents a charge amount of the image bearing member,

S represents a charge area of the image bearing member, d represents a film thickness of the photosensitive layer, $\varepsilon_r$ represents a specific permittivity of the binder resin contained in the photosensitive layer, $\varepsilon_0$ represents the vacuum permittivity, V represents a value calculated from an equation $V=V_0-V_r$, $V_r$ represents a first potential of the circumferential surface of the image bearing member yet to be charged in the charging, and $V_0$ represents a second potential of the circumferential surface of the image bearing member charged in the charging.

* * * * *